US011709032B2

(12) United States Patent
Hanson et al.

(10) Patent No.: US 11,709,032 B2
(45) **Date of Patent: *Jul. 25, 2023**

(54) GAS POWERED SEMI-AUTOMATIC AIRGUN ACTION

(71) Applicant: Crosman Corporation, Bloomfield, NY (US)

(72) Inventors: Jeffrey D. Hanson, Honeyoye Falls, NY (US); David Snyder, Palmyra, NY (US); Christopher Hand, Rochester, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/856,117

(22) Filed: Jul. 1, 2022

(65) Prior Publication Data

US 2022/0333894 A1 Oct. 20, 2022

Related U.S. Application Data

(63) Continuation of application No. 17/152,550, filed on Jan. 19, 2021, now Pat. No. 11,378,352.

(51) Int. Cl.

| | |
|---|---|
| ***F41B 11/00*** | (2013.01) |
| ***F41B 11/721*** | (2013.01) |
| ***F41A 17/82*** | (2006.01) |
| ***F41B 11/642*** | (2013.01) |

(52) U.S. Cl.
CPC ..... *F41B 11/721* (2013.01); *F41A 17/82* (2013.01); *F41B 11/642* (2013.01)

(58) Field of Classification Search
CPC ..... F41B 11/72; F41B 11/73; F41B 11/721; F41B 11/723; F41B 11/62; F41B 11/57; F41B 11/71; F41B 11/642; F41A 17/82
USPC ..... 124/73–77
See application file for complete search history.

(56) References Cited

U.S. PATENT DOCUMENTS

| | | | | |
|---|---|---|---|---|
| 4,539,969 | A * | 9/1985 | Saxby | F41B 11/62 124/58 |
| 5,161,516 | A | 11/1992 | Ekstrom | |
| 5,285,766 | A | 2/1994 | Milliman | |
| 5,341,790 | A | 8/1994 | Ebert | |
| 5,349,939 | A | 9/1994 | Perrone | |
| 5,727,538 | A | 3/1998 | Ellis | |
| 5,813,392 | A | 9/1998 | McCaslin | |
| 6,497,229 | B1 | 12/2002 | Maeda | |
| 6,530,368 | B1 * | 3/2003 | Maeda | F41B 11/55 124/48 |
| 6,688,298 | B2 | 2/2004 | Maeda et al. | |
| 7,150,276 | B1 | 12/2006 | Rice | |
| 7,581,954 | B2 * | 9/2009 | Schavone | F41A 33/06 434/21 |
| 7,766,000 | B2 * | 8/2010 | Maeda | F41B 11/723 124/74 |

(Continued)

FOREIGN PATENT DOCUMENTS

| | | |
|---|---|---|
| EP | 1729082 | 12/2006 |

OTHER PUBLICATIONS

Search Report and Written Opinion for PCT Application No. PCT/US21/65684, dated Mar. 8, 2022.

*Primary Examiner* — Michael D David
(74) *Attorney, Agent, or Firm* — Lee & Hayes, P.C.

(57) ABSTRACT

Airguns are provided with semi-automatic action.

20 Claims, 17 Drawing Sheets

(56) References Cited

U.S. PATENT DOCUMENTS

| | | | | |
|---|---|---|---|---|
| 7,886,731 | B2 * | 2/2011 | Masse | F41B 11/721 124/73 |
| 8,322,329 | B1 | 12/2012 | Sikes | |
| 8,413,644 | B2 * | 4/2013 | Masse | F41B 11/73 124/76 |
| 8,578,922 | B1 | 11/2013 | Granger | |
| 8,651,096 | B2 * | 2/2014 | Sikes | F41B 11/724 124/73 |
| 9,739,564 | B2 * | 8/2017 | Nachefski | F41B 11/62 |
| 9,982,962 | B2 * | 5/2018 | Kras | F41B 11/73 |
| 10,712,112 | B2 * | 7/2020 | Maeda | F41A 17/56 |
| 10,955,216 | B2 * | 3/2021 | Pedicini | F41B 11/64 |
| 11,098,977 | B2 * | 8/2021 | Cherry | F41B 11/723 |
| 11,346,634 | B2 * | 5/2022 | Sullivan | F41B 11/721 |
| 11,378,352 | B1 * | 7/2022 | Hanson | F41B 11/721 |
| 2005/0235975 | A1 * | 10/2005 | Pedicini | F04B 9/02 124/67 |
| 2005/0260545 | A1 | 11/2005 | Schavone | |
| 2006/0162711 | A1 | 7/2006 | Maeda et al. | |
| 2007/0017497 | A1 | 1/2007 | Masse | |
| 2009/0235910 | A1 | 9/2009 | Maeda | |
| 2009/0241931 | A1 | 10/2009 | Masse | |
| 2010/0031944 | A1 | 2/2010 | Maeda | |
| 2010/0282324 | A1 | 11/2010 | Page et al. | |
| 2010/0319668 | A1 | 12/2010 | Maeda | |
| 2010/0326414 | A1 | 12/2010 | Maeda | |
| 2011/0083653 | A1 | 4/2011 | Kawashima | |
| 2013/0263840 | A1 | 10/2013 | Maeda | |
| 2015/0241165 | A1 | 8/2015 | Tippmann, Sr. | |
| 2016/0146567 | A1 | 5/2016 | Nachefski | |
| 2017/0089664 | A1 | 3/2017 | Kras et al. | |
| 2020/0025511 | A1 | 1/2020 | Cherry et al. | |
| 2020/0132412 | A1 | 4/2020 | Pedicini | |

* cited by examiner

GAS POWERED SEMI-AUTOMATIC AIRGUN ACTION

CROSS REFERENCE TO RELATED APPLICATION

This application is a continuation of, and claims priority to, U.S. patent application Ser. No. 17/152,550, filed on Jan. 19, 2021, the entire contents of which are incorporated herein by reference.

STATEMENT REGARDING FEDERALLY SPONSORED RESEARCH OR DEVELOPMENT

N/A

REFERENCE TO SEQUENCE LISTING, A TABLE, OR A COMPUTER PROGRAM LISTING COMPACT DISC APPENDIX

N/A

FIELD OF THE INVENTION

This invention relates to airguns having actions capable of semi-automatic fire.

BACKGROUND OF THE INVENTION

Airguns are known that can provide semi-automatic action. In some cases, a revolver type action is used, where the force of the trigger pull advances one of a plurality of preloaded cylinders into a position for firing and cocks the hammer for firing. One example of this is U.S. Pat. No. 5,285,766 entitled "Gun with Removable Rotary Ammunition Clip" filed by Milliman on Jul. 30, 1992.

Other airguns secure semi-automatic action by diverting propellant such as pressurized gas from a supply that to propel ammunition to operate the action.

Still other airguns attempt to recycle used pressurized propellant gas for the purpose of operation the action. This approach adds weight cost and complexity to the airgun. One example of this can be found in EP1729082, entitled "Automatic Gas Powered Gun" filed by Axelsson on or about Jun. 3, 2005.

Still other airguns use electronic and electromechanical systems to provide semi-automatic action. The use of electronic and electromechanical systems adds weight, cost and complexity. Examples of such airguns are described in U.S. Pat. No. 8,578,922, filed by Granger on Jul. 17, 2009.

What is needed in the art is an airgun and methods for operating an airgun that enable operation of an airgun in an efficient, light weight and cost-effective manner.

SUMMARY OF THE INVENTION

Airguns and methods for operating an airgun are provided. In one aspect an airgun has a valve configured to release pressurized gas when a valve stem is moved from a closed position and a range of open positions. a hammer biased by a hammer spring to move along a hammer path from a cocked position to drive the valve from the closed position through the range of open positions causing the valve to release a flow of pressurized gas and a primary sear movable between a primary sear cocked position where a primary sear hammer catch is in the hammer path to hold the hammer at a hammer cocked position to a primary sear return position where a primary sear return surface is in the hammer path. A secondary sear is movable between secondary sear cocked position that prevents the primary sear from moving from the primary sear cocked position to a primary sear fired position allowing primary sear to move from the cocked position to the fired position so that the hammer can strike the valve stem; and a secondary sear spring biases the secondary sear toward the secondary sear cocked position. A trigger is movable between a non-firing trigger position and a trigger fired position, and, a lift movable between an engaged position mechanically links the secondary sear to the trigger so that the secondary sear moves to the secondary sear fired position as the trigger is moved to the trigger fired position allowing the hammer to move the primary sear from the primary sear cocked position to the primary sear return position. A portion of the gas released from the valve during firing travels to the hammer path and drives the hammer along the hammer path away from the valve stem so that the hammer travels to a return position and drives the primary sear from the return position to the primary cocked position; and the lift is disengaged after firing to allow separate movement of the trigger and the secondary sear, so that the secondary sear spring moves to the secondary sear cocked position to hold the primary sear in the primary sear cocked position before the hammer spring biases the hammer to move from the return position to a cocked position.

DETAILED DESCRIPTION OF THE DRAWINGS

DETAILED DESCRIPTION

Figure 1:
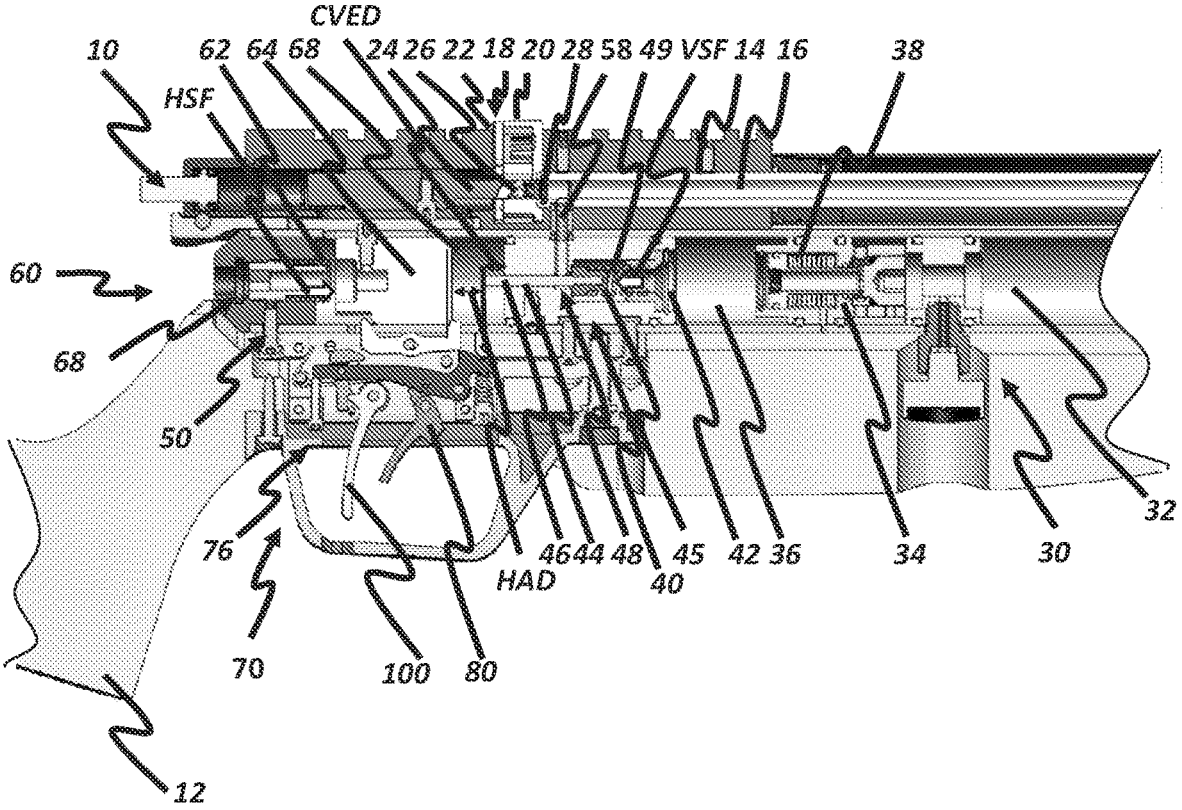
FIG. 1 is a cross-section view of one embodiment of a pre-charged gas airgun with portions of a stock and barrel cut away.
Figure 2:
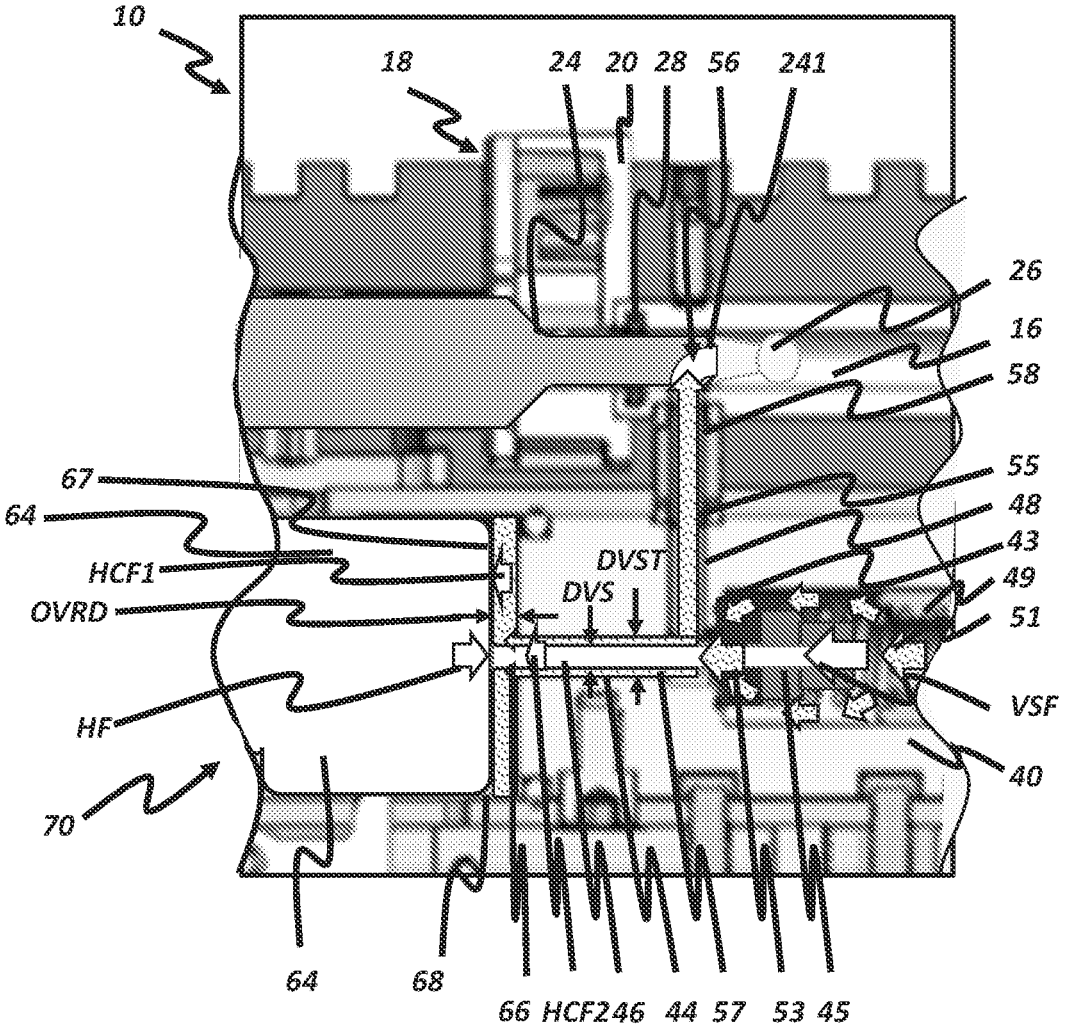
FIG. 2 is a cutaway cross-section right side view of the embodiment of FIG. 1 illustrating flows of pressurized gas flow when a valve is opened.
Figure 3:
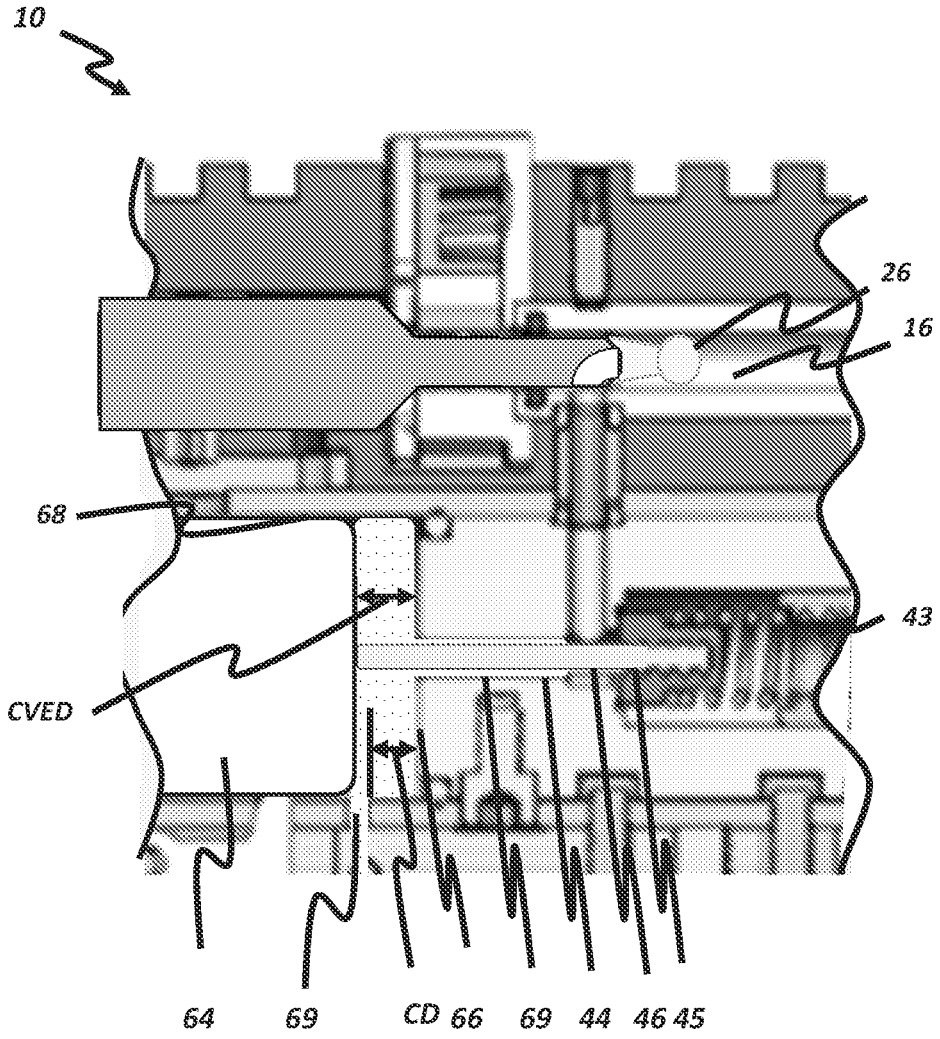
FIG. 3 is a cutaway cross-section right side view of the embodiment of FIG. 1 illustrating release of pressurized gas from a hammer path.
Figure 4:
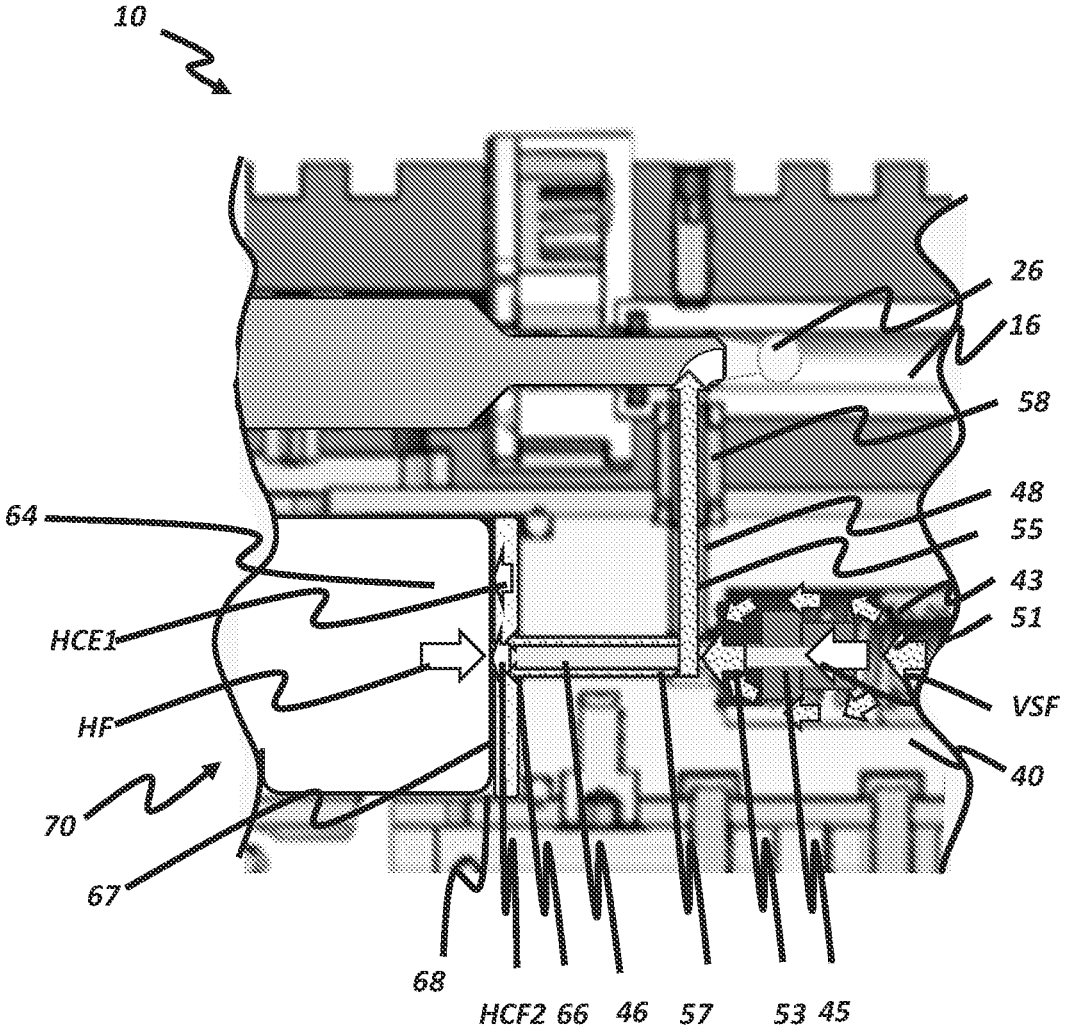
FIG. 4 is a cutaway cross-section right side view of the embodiment of FIG. 1 with a valve open.

FIG. 1 is a cross-section view of one embodiment of a pre-charged gas airgun 10 with portions of a stock 12 and barrel 14 cut away. FIG. 2 is a cutaway cross-section view of the embodiment of FIG. 1 illustrating flows of pressurized gas flow when a valve is opened. FIG. 3 is a cutaway cross-section right side view of the embodiment of FIG. 1 illustrating release of pressurized gas from a hammer path. FIG. 4 is a cutaway cross-section right side view of the embodiment of FIG. 1 with a valve open.

As is shown in FIG. 1, airgun 10 has a stock 12, and a barrel 14 with a bore 16, a projectile loading system 18 and a projectile storage system 20. Projectile storage system 20 is capable of storing a plurality of individual projectiles 26 and of cooperating with projectile loading system 18 to position one of the projectiles 26 in loading area 21.

Projectile loading system 18 and projectile storage system 20 are designed so that during a loading process, one of the plurality of projectiles 26 stored in the projectile storage system 20 can be moved to a loading area 21 from which projectile 26 can be advanced ultimately through bore 16.

In the embodiment illustrated, projectile storage system 20 takes the form of a removable projectile storage system 20 and projectile storage system 20 is configured to cooperate with projectile loading system 18 to removably position storage system 20 so that loading area 21 is positioned where movement of a bolt 24 can drive projectile 26 to bore 16. Other embodiments are possible.

The use of a removable type projectile storage system 20 to store projectiles 26 is exemplary only and in other embodiments, other forms of projectile storage systems 20 can be used including but not limited to belts, chains, carousels, drums, or any other form of projectile storage systems 20. In embodiments, projectile storage system 20 may be separable from airgun 10 as described in this embodiment or as or may be integrated therewith.

A supply of pressurized gas 30 is provided including a pressurized gas vessel 32 which supplies pressurized gas for use in operating airgun 10.

In the embodiment of FIG. 1, an optional regulator 34 is provided that is adapted to receive gas from pressurized gas vessel 32 with the received gas having a first range of pressures and provides a regulated gas having a second range of pressures that is smaller than the first range of pressures to ensure more consistent airgun operation.

In this embodiment, a regulated pressurized gas storage chamber 36 is connected between regulator 34 and valve 40 and provides a buffer volume of regulated pressurized gas to a valve 40.

Valve 40 is configured to release pressurized gas from supply of pressurized gas 30 or from regulated pressurized gas storage chamber 36 when a valve stem 46 is moved against a bias relative to other components of valve 40.

In the embodiment here, valve 40 has valve body 41 with an input 42 connected to pressurized gas storage chamber 36, a valve seat 43, a valve stem path 44, a valve seal 45, and a valve output path 48.

Valve seal 45 is mechanically associated with valve stem 46 and is movably positioned within valve body 41 between a sealing position where valve seal 45 is closed against a valve seat 43 as shown in FIG. 1 and one of a range of non-sealing positions where valve body 41 is separated from valve seat 43 to allow pressurized gas to flow past valve seat 43 and valve seal 45. One example of such a non-sealing position is shown in FIG. 2.

In this embodiment, valve stem 46 is slidably located in valve stem path 44 and valve stem path 44 has a cross-sectional diameter that is at least larger than a diameter of valve stem 46 by an amount sufficient to allow such movement. Additionally, as will be described in greater detail below, a diameter of valve stem path 44 (DVST) can be oversized with respect to a diameter of valve stem 46 (DVS) by an amount that is sufficient to permit airflows as described later herein.

Valve seal 45 is biased against valve seat 43 by a combination of valve sealing forces VCF provided by pressurized gasses from chamber 36 and a valve sealing spring 49.

In the embodiment illustrated in FIGS. 1 and 2, valve seal 45 and valve stem 46 are mechanically linked such that movement of valve stem 46 within valve stem path 44 requires associated movement of valve seal 45. In this embodiment, valve seal 45 and valve stem 46 are directly connected. Valve stem 46 is aligned with an axis of movement of valve seal 45 between the position where valve seal 45 is closed against valve seat 43 the range of positions where valve seal 45 is separated from valve seat 43. A hammer system 60 having a hammer 64 movable along a hammer path 68 at least between a cocked position and a range of fired positions. A hammer spring 62 urges hammer 64 to move from the cocked position through the range of fired positions.

In the embodiment illustrated, valve 40 provides a hammer path end wall 66 that closes hammer path 68 with valve stem path 44 providing a path from hammer path end wall 66 to valve seal 45 allowing valve stem 46 to extend from valve seal 45 into hammer path 68. In other embodiments, a hammer path end wall 66 can be a portion of structures other than valve 40.

As is shown in FIG. 1, valve 40 is configured and positioned so that valve stem 46 extends from hammer path end wall 66 in hammer path 68 by a closed valve extension distance VED when valve 40 is closed. Further, valve 40 is configured so that valve stem 40 can be moved by hammer 64 through a range of open positions where valve 40 releases pressurized gas, with the range of open positions including a return position shown in FIG. 2 that is separated from the hammer path end wall 66 by a valve return extension distance CVED that is less than the closed valve extension distance CVED.

An action 70 has a fire control system 76 that holds hammer 64 in the cocked position until a user fires airgun 10 by manipulating a safety 80 and trigger 100. As can be seen in FIG. 1, when action 70 holds hammer in the cocked position, hammer 64 is held apart from valve stem 46 by hammer acceleration distance HAD.

When action 70 releases hammer 64, hammer spring 62 accelerates hammer 64 through the hammer acceleration distance HAD to strike valve stem 46 with a hammer force HF sufficient to move valve stem 46 and valve seal 45 from a closed position through the range of open positions where valve seal 45 is separated from valve seat 43.

As is shown in FIG. 2, in this embodiment, a flow of regulated pressurized gas 51 flows around valve seal 45 to provide a released flow 53 of regulated pressurized gas. One portion of released flow 53 creates a motive flow 55 that travels through valve output path 48 to transfer tube 58 and another portion of released flow 53 creates a cocking flow 57 that flows between valve stem path 44 and valve stem 46.

In the embodiment illustrated in FIGS. 1 and 2, motive flow 55 is directed by transfer tube 58 to an accumulation volume 56 between bolt 24 and projectile 26. An optional bolt seal 28 such as an O-ring provides a seal between bolt 24 and bore 16 on one side of transfer tube 58 and projectile 26 provides resistance to gas flow on another side of transfer tube 58.

As bore 16 is configured to expand only within a very limited range when exposed to motive flow 55, pressurized gas from motive flow 55 begins accumulate in an accumulation volume 56 between at least bolt 24 and projectile 26 and optionally also between bore 16 and bolt seal 28. Bolt 24, projectile 26 and any other structures forming accumulation volume 56 are exposed to the forces created as motive flow 55 passes into accumulation volume. As motive flow 55 passes into accumulation volume 56 increasing pressure and force against each ultimately rising to a level that delivers the predetermined range of force against projectile 26 necessary to thrust projectile 26 out of bore 16.

In this embodiment, accumulation volume 56 is provided in part by a channel 241 in bolt 24 that is shaped to receive motive flow 55 and to expose projectile 26 to the pressure created as motive flow 55 flows into accumulation volume 55.

In still other embodiments, projectile 26 can be shaped to provide an accumulation volume 56 within a length of projectile 26 and a path for motive flow 55 to flow into the length of projectile 26. While in other embodiments, airgun 10 can be configured so that bolt 24 or projectile 26 are separated to provide an accumulation volume 56 which motive flow 55 can rapidly fill.

Airgun 10 is configured so that projectile 26 remains generally stationary until motive flow 55 applies a predetermined level of motive force against projectile 26.

In one non-limiting example embodiment, bore 16 and projectile 26 are sized and configured so that static friction between bore 16 and projectile 26 will provide a holding force that must be overcome before projectile 26 can transit bore 26.

Further, in this embodiment, bore 16 is optionally rifled such that projectile 26 must be plastically deformed with a pattern of rifling grooves before traveling down bore 16. In this regard, projectile 26 may be made using a material that has sufficient ductility to allow such grooves to be formed when as predetermined amount of force is applied to projectile 26. In such an embodiment a holding force may be provided in part by an amount of force necessary to conform projectile 26 to the rifling groves.

Different configurations of projectile size, bore size, rifling and other configurations and mechanisms known in the art can be used to help ensure that projectile 26 remains relatively stationary until a predetermined range of pressure is reached in accumulation volume 56 and any can be applied here for this purpose.

Ultimately, the predetermined range of pressures is reached and projectile 26 is thrust through bore 16 completing a firing cycle.

To enable semi-automatic action airgun 10 then returns to a cocked and loaded state where valve 40 is closed, hammer 64 is returned to the cocked position, and action 70 is reset to hold hammer 64 in the cocked position and projectile loading system 18 and projectile storage system 20 to preposition another projectile 26 in bore 16 for firing.

In the embodiments that are described herein, airgun 10 returns to the cocked and loaded state without the necessary aid of electronic timing controls and actuators, electromechanical timing controls and actuators or manual user intervention as will now be described.

Hammer Return

In the embodiment shown in FIGS. 1 and 2, hammer 64 is returned to the cocked position by a combination of a first hammer cocking force HCF1 supplied against hammer 64 by a cocking flow 57 of pressurized gas in combination with a second hammer cocking force HFC2 supplied by valve 40 against hammer 64.

As can be seen in FIGS. 1-5, valve stem path 44 is in fluid communication with valve output path 48 such that released flow 53 confronts two possible flow paths creating two separate flows: motive flow 55 that travels through valve output path 48 as described above and a cocking flow 57 that travels between valve stem path 44 and valve stem 46.

In conventional valve designs of this type, gas flow between valve stem path 44 and valve stem 46 is limited or blocked by design in order to limit losses. This can be done for example by providing a valve stem path 44 having a first diameter that is only slightly larger than that of a valve stem 46 to limit gas travel through the valve stem tube. In some cases, lubricants between the valve stem 46 and valve stem path 44 provide a sealing effect.

In contrast, in this embodiment, valve stem path 44 and valve stem 46 are shaped and sized to permit sufficient flow of cocking air flow 57 for purposes that will be described presently.

In this embodiment, hammer 64, hammer path 68 and hammer path end wall 66 are configured to limit an extent to which cocking flow 57 can escape containment area 65 such that cocking flow 57 into containment area 65 creates a cocking pressure that generates a first hammer cocking force HCF1 against hammer 64.

As is shown in FIG. 2 and in enlarged form in FIG. 4, when valve seal 45 is moved into a range of non-sealing positions, valve spring 49 is compressed. Valve spring 49 resists such compression by applying a second hammer cocking force HCF2.

As hammer 64 continues to move in the firing direction, the volume of containment area 65 shrinks while cocking flow 57 of compressed air continues to be injected into the shrinking containment area 65. As a result, cocking pressure quickly builds in containment area 65 causing a rapid increase in the amount of first hammer cocking force HCF1.

Further, as hammer 64 continues to move in the firing direction, valve seal 45 and valve stem 46 continue to be displaced relative to valve body 41 causing valve spring 49 to be elastically deformed. This in turn stores an increasing level of potential energy in valve spring 49 and increases the resistance of valve spring 49 to further elastic deformation. Accordingly, second hammer cocking force HCF2 increases while kinetic energy from hammer 64 decreases.

Ultimately, hammer 64 drives valve stem 46 to a return position where the sum of the first hammer cocking force HCF1 and the second hammer cocking force HCF2 equals the hammer force HF that hammer 64 applies against valve stem 46. Thereafter, hammer 64 begins to be accelerated through hammer path 68 in a cocking direction away from valve 40 by the first hammer cocking force HCF1 and the second hammer cocking force HCF2.

To provide energy that can thrust a projectile 26 down range at speed, regulated flow 51 may be maintained at a high pressure which can be, for example and without limitation, 40-200 times larger than atmospheric levels. At such pressures only a momentary opening of valve 40 may be necessary to deliver a released flow 53 that generates a motive flow 55 that can provide desired thrust to a projectile 26.

In such embodiments, the high pressure of released flow 53 will allow cocking flow 57 to rapidly flow in the space between valve stem path 44 and valve stem 46. Cocking flow 57 flows into a containment area 65 between hammer 64, a hammer path end wall 66 and a portion of hammer path 68 proximate to valve 40.

Additionally, to limit losses of high pressure compressed gas, valve 40 may be configured so that one or more forces that bias valve 40 into the closed state may urge rapid closure of valve 40. In such embodiments, valve spring 49 may have a high spring constant such that significant forces are required to urge valve seal 45 away from valve seat 43 and such that valve spring 49 quickly return valve seal 45 against valve seat 43 when forces acting on valve stem 46 diminish. Further, gas pressure provided by pressurized gasses contained in valve 40 by valve seal 45 may also act to increase the force required to open valve 40 and to supply forces that assist in rapidly closing valve 40.

In view of such valve design considerations, hammer 64 and hammer spring 62 may be configured to accelerate hammer 64 so that hammer 64 strikes valve stem 46 with sufficient kinetic energy to drive open valve 40.

Hammer spring 62 and hammer 64 rapidly expend this kinetic energy as hammer 64 drives valve stem 46 from the closed position to the open valve return position wherein valve stem 46 extends by an open valve return distance OVRD into containment area 65.

As this kinetic energy is consumed, the force applied by hammer 64 against valve stem 46 drops to a level where hammer 64 can no longer overcome the forces urging valve seal 45 and valve stem 46 to close. This occurs when valve 40 is in the open valve return position. Thereafter, these forces forcefully urge valve seal 45 to move to the closed valve position against valve seat 43 and urge valve stem 46 to drive hammer 64 away from end wall 67

It will be observed however, that when hammer 64 is a the return point, hammer 64 continues to be urged by hammer spring 62 to remain in contact with valve stem 46. Thus, to close valve 40, sufficient forces must be applied against hammer 64 to move hammer 64 at least out of valve extension distance VED of valve stem 46.

However, this merely permits valve 40 to close. To enable semi-automatic action hammer 64 must travel against the urging of hammer spring 62 over the length of the hammer acceleration distance HAD after contact with valve stem 46 is ended.

Accordingly, in the embodiment of FIG. 1, airgun 10 is configured so that the combination of first hammer cocking force HCF1 and second hammer cocking force HCF2 accelerate hammer 64 so that hammer 64 will have sufficient kinetic energy to travel at least to the cocked position against the action of hammer spring 62 after contact with valve stem 46 ends.

In an airgun, it can be important to limit any unnecessary expenditure of compressed gas. Accordingly, the embodiment of FIG. 1, has a valve 40 that is configured with a valve spring 49 with a stiffness that helps to receive kinetic energy from hammer 64 and to return a meaningful proportion of the kinetic energy delivered by hammer 64 against valve stem 46 to hammer 64 by way of second hammer cocking force HCF2.

As friction and other considerations dictate that such a system cannot return all of the kinetic energy supplied by hammer 64 against valve stem 40, first hammer cocking force HCF1 uses energy from cocking flow 57 for the principal purposes of replacing energy lost in the firing process and further providing sufficient kinetic energy to cover kinetic energy lost to friction or other forces as hammer 64 is thrust at least to the cocking position.

In embodiments, the application of first hammer cocking force HCF1 and second hammer cocking force HCF2 over time are established to impart a predetermined cocking kinetic energy to hammer 64 that is also at least sufficient to allow hammer 64 to interact with action 70 cause action 70 return to a state where action 70 will hold hammer 64 in the cocked position.

In embodiments, first hammer cocking force HCF1 and second hammer cocking force HCF2 may be established to impart a predetermined cocking kinetic energy to hammer 64 that is at least sufficient to drive hammer 64 along hammer path 68 past the cocking position with action 70 being configured to interact with hammer 64 and return to a state where action 70 can hold hammer 64 in the cocked position before hammer spring 62 urges hammer to return to the cocking position.

In this way, supply of pressurized gas 30 is used to deliver a first hammer cocking force HCF1 that supplements energy recycled by valve spring 49 the second hammer cocking force HCF2 as necessary to return hammer 64 at least to the cocking position and this limits the extent to which such pressurized gas is consumed.

In the embodiment that is shown in FIGS. 1 and 2 an O-ring 59 is provided to help prevent loss of pressurized air between hammer path end wall 66 and hammer path 68.

Gas Management in Hammer Path

It will be appreciated, that for first hammer cocking force HCF1 to provide a predetermined contribution to the kinetic energy needed to return hammer 64 to the cocking position, the ability of gas to escape containment area 65 must be limited.

However, it will also be appreciated that prior to firing airgun 10, hammer path 68 typically contains a column of air. To the extent that this column of air becomes trapped in containment area 65, there is a risk that a portion of the energy from the moving hammer 64 may be consumed in compressing gasses in hammer path 68. Accordingly, it is necessary to manage gas flow within hammer path 68 to ensure proper interaction between hammer 64 and valve 40.

As best illustrated in FIG. 3, in this embodiment hammer path 68 includes a gas escape 69. Gas escape 69 is separated from hammer path end wall 66 by a containment distance CD.

As hammer 64 travels toward valve stem 46 during firing, air in hammer path 68 is thrust out of hammer path 68 through gas escape 69. However, when hammer 64 is moved through a range of positions apart from hammer path end wall 66 that is greater than the containment distance CD, gas located between hammer 64, hammer path end wall 66 and hammer path 68 can freely transfer out of hammer path 68 through gas escape 69.

Gas escape 69 thus limits the amount of gas available for pressurization between hammer 64, hammer path end wall 66 and hammer path 68 as hammer 64 travels to impact valve stem 46 and provides a first to manage gas in hammer path 68 during firing.

Optionally a further mechanism to manage gas in hammer path 68 is the availability of the space between valve stem path 44 and valve stem 46 to receive air from hammer path 68. That is, as discussed above, valve stem path 44 provides an opening in hammer path end wall 66 into which air can flow after hammer 64 passes gas escape 69. However, as is also discussed above, the presence of valve stem 46 in valve stem path 44 limits the flow of any gas or gasses through valve stem path 44.

The order or relative timing of the opening of valve 40 and the interference of hammer 64 with the flow of gas from gas escape 69 can be adjusted as needed to manage pressures created by gases within hammer path 68.

For example, in embodiments such as the one illustrated in FIG. 1, valve stem 46 has a closed valve extension distance CVED that is greater than the containment distance CD such that hammer 64 strikes valve stem 46 at a point where hammer 64 does not fully block the flow of gasses through gas escape 69.

This is illustrated in FIG. 3 which shows hammer 64 at a point in time when hammer 64 is immediately proximate to but not yet in contact with valve stem 46. This prevents formation of containment area 65 until after hammer 64 strikes valve stem 46 and thereby limits any potential losses of kinetic energy in hammer 64 that might be caused by compression of gasses in hammer path 68.

However, as is shown in FIG. 4, impact between hammer 64 and valve stem 46 drives valve stem 46 through the range of open positions including positons where hammer 64 restricts gas flow through gas escape 69 to form containment area 65. Any effects of compression of any remaining gas in containment area 65 caused by movement of hammer 64 may be limited by the ability of the compressed hammer tube gases to flow through valve stem path 44, as noted above.

In embodiments, the volume of containment area 65 may be reduced as hammer 64 drives valve stem 40 to the return position where valve stem 46 extends into hammer path 68 from hammer path end wall 66 by an open valve return distance OVRD.

As this occurs, cocking flow 57 flows into containment area 65. The combination of reduced volume of containment area 65 and the injection of cocking flow 57 into containment area 65 creates a cocking pressure that acts against all surfaces forming containment area 65.

It will be appreciated that while this approach manages the risk of compression related energy losses during firing, this approach imposes a limitation on the extent to which second hammer cocking force HCF2 can act against hammer 64 to impart kinetic energy during cocking.

Specifically, it will be appreciated that as hammer 64 is moved in the cocking direction, hammer 64 passes gas escape 69. This allows cocking flow 57 to escape through gas escape 69 and ends the contribution of first hammer cocking force HCF1 to accelerating hammer 64 in the cocking direction.

As gas escape 69 is separated from the cocked position, hammer 64 cocking flow 57 must be such that first hammer cocking force HCF1 has supplied hammer 64 with any required kinetic energy before hammer 64 passes gas escape 69.

Accordingly, valve stem path 44 will have a diameter that is larger than that of valve stem 46 by an extent that is sufficient to enable a volume of cocking flow 57 to pass into containment area 65 as may Similarly, characteristics of valve stem path 44, valve stem 46, and elements forming part of containment area 65 will be adapted to ensure that hammer 64 receives any necessary kinetic energy in the available time.

In embodiments, valve stem path 44 may have a cross-sectional area that is oversized relative to a cross-sectional area of valve stem 46 by an amount that is calculated to allow released flow 53 to generate a cocking flow 57 that flows through valve stem path 44 and into hammer path 68 at a predetermined rate determined at least in part based upon any or all of the gas pressures available, the cross sectional area against which cocking pressures can act against hammer 64, a pressure of released flow 53, a pressure of cocking flow 57 and Similarly, a spring stiffness of valve spring 49, closed valve extension distance VED and a return extension distance RED may be determined to optimize the return of kinetic energy to hammer 64 by way of valve stem 46 during the time in which hammer 64 is thrust from the open valve extension distance OVED to the closed valve extension distance CVED.

In embodiments, hammer path end wall 66 may provide an opening (not shown) that is shaped to receive cocking flow 57 from valve stem path 44 and to control the extent, rate or distribution of cocking flow 57 as cocking flow 57 flows into hammer path 68.

In the embodiment of FIG. 1, hammer system 60 is also shown with an optional de-gassing system 50. De-gassing system 50 allows a user to utilize a special tool to manually drive hammer 64 into controlled and sustained contact with valve stem 46 to allow controlled release of gas from supply of pressurized gas 30 in the event that, for example, the user wishes to release stored gas pressure during times when the air gun will not be used Accordingly, various embodiments of an airgun 10 are provided with a valve 40 and hammer system 60 in which hammer 64 is caused to rapidly move from a cocked position apart from a valve 40 to a position in contact with the valve that causes valve 40 to open and that then uses a combination of force from valve 40 and from a cocking gas flow to impart sufficient kinetic energy in hammer 64 to allow hammer 64 to return to the cocked position, while also storing sufficient energy in hammer spring 62 to allow this process to repeat. Additionally, hammer 64 has sufficient kinetic energy to interact with an action 70 in a manner that initiates the process or returning action 70 to a state where action 70 can hold hammer in the cocked position as will be described presently.

In this embodiment, hammer 64 comes into contact with valve stem 46 after hammer 64 at a time when hammer 64 has not yet fully passed escape 69 to form containment area 65. The closed valve extension distance VED is greater than the containment distance CD to limit such losses under any other conditions where hammer 64 is configured so that hammer 64 passes and closes gas escape 69 before striking valve stem 46.

Action: First Embodiment

Figure 5:
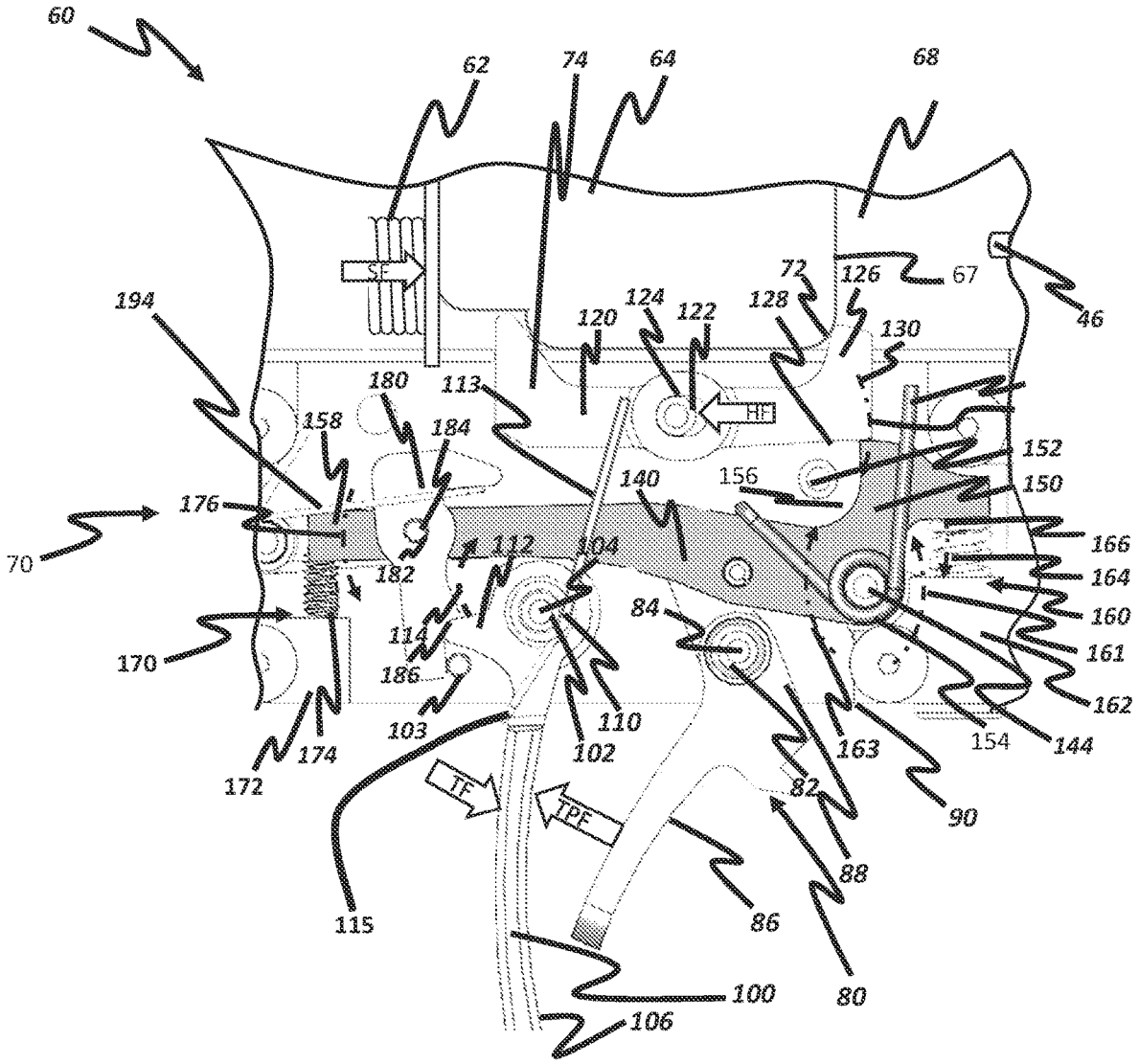
FIG. 5 is a right side cutaway cross-section view of the airgun of FIG. 1 having a first embodiment of an action in a cocked state and a safety disengaged.

FIG. 5 is a right side cutaway cross-section view of the airgun of FIG. 1 having a first embodiment of an action in a cocked state and a safety disengaged.

In the embodiment illustrated in FIG. 5, action 70 has a fire control mechanism 76, a safety 80 and a trigger 100. Fire control mechanism 76 interacts with hammer system 60 to prevent hammer 64 from moving from the cocked position shown in FIG. 1 unless a user has moved safety 80 from an engaged position shown in FIG. 1 to a disengaged position as shown in FIG. 2 and further moves trigger 100 from a first trigger position shown in FIG. 1 to a second trigger position shown in FIG. 5.

The operation of the embodiment of action 70 of FIG. 1, will now be described in greater detail with respect to FIGS. 5-10.

FIG. 5 shows a right side view of hammer system 60 and action 70 of FIG. 1 in a cocked state with other portions of airgun 10 cut away.

As is shown in FIG. 5, in this embodiment, safety 80 has a safety pivot mount 82 that is mounted to a safety pivot 84 of airgun 10. On a first side of safety pivot mount 82 is a safety control surface 86 configured to interact with a user's finger so that the user can move safety 80 between a safety disengaged position shown in FIG. 5 and a safety engaged position shown in FIG. 1.

In this embodiment, safety 80 includes a safety stop surface 88 that is adapted to engage a frame stop surface 90. The point at which point safety stop surface 88 engages frame stop surface 90 blocks movement of safety control surface 86 to provide a user who is moving safety control surface 86 from the engaged position to the safety disengaged position with a tactile indication that safety 80 has reached the safety disengaged position.

As is also shown in this embodiment, safety 80 has a hook 92 that is positioned on a side of safety pivot mount 82 opposite from safety control surface 86.

Figure 8:
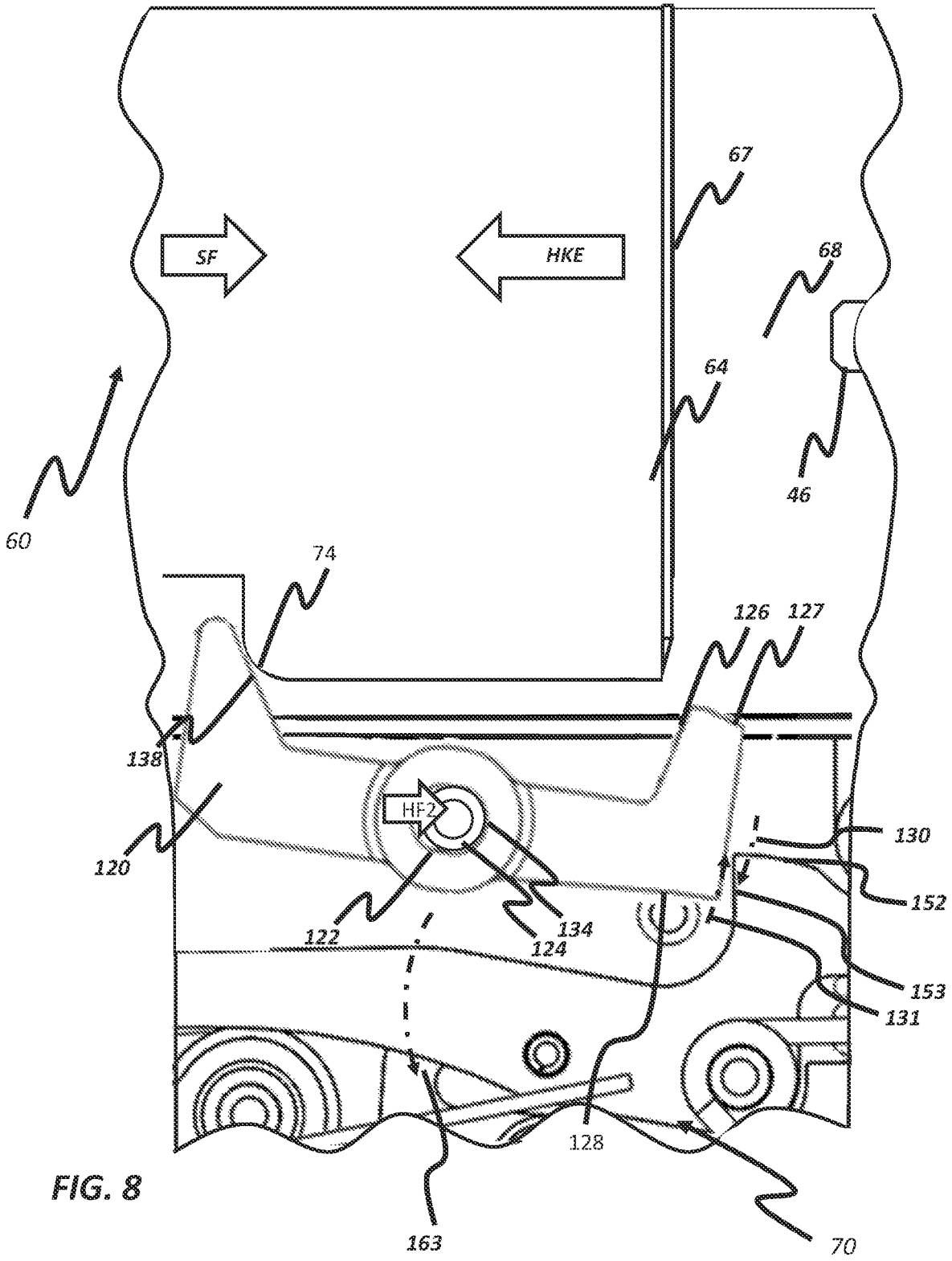
FIG. 8 is a right side cutaway cross-section enlarged view of portions of a hammer system and the action of FIG. 5 as hammer moves in the cocking direction into contact with a deflection surface of a primary sear.

As noted above, trigger 100 has a trigger pivot mount 102 pivotally mounted to a trigger pivot 104 and a trigger control surface 106 configured to engage with a finger of a user so that a user can move trigger 100 between a cocked position shown in FIG. 5 and a fired position shown in FIG. 8.

A trigger spring 110 is mounted about trigger pivot 104 and applies a trigger force TF biasing trigger 100 toward the non-fired position. Trigger spring has a primary sear bias leg 113 described later and a trigger reset contact leg 115 that urges trigger 110 from the fired position to the non-fired position or range of non-firing positions.

Trigger 100 also has a trigger tab 112 that rotates with trigger 100 along a trigger tab path 114 as trigger 100 is moved from the non-fired position to the trigger fired position.

A positioning pin 103 is positioned in a path of movement of trigger 100 to stop movement of trigger at or after trigger 100 has been moved to a trigger fired position.

Action 70 has a primary sear 120 that is movable between a cocked position, that blocks hammer 64 from traveling along a hammer path 68 when hammer 64 is in a cocked position apart from valve stem 46 to a fired position allowing hammer 64 to move along hammer path 68 into contact with valve stem 46 and to return from this contact.

Figure 6:
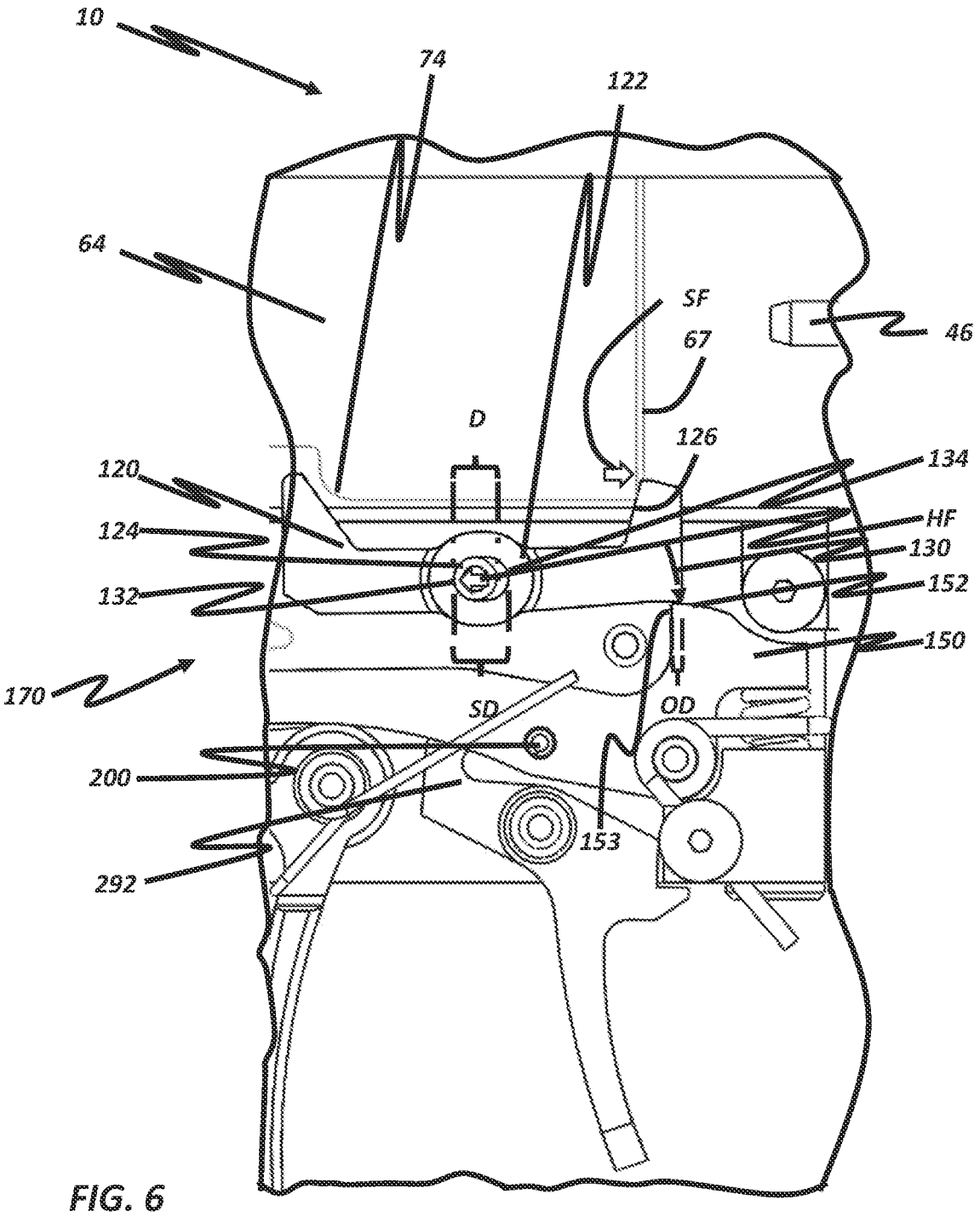
FIG. 6 is a right side cutaway cross-section enlarged view of the action of FIG. 5 having a first embodiment of an action in a cocked state and a safety disengaged.

In FIG. 6, primary sear 120 is shown in a cocked position and has a slide pivot mount 122 that is pivotally and is slidably mounted about a primary sear pivot 124. Primary sear 120 is configured and positioned by primary sear pivot 124 so that a hammer catch 126 can be movably positioned between the cocked position and the fired positon. Hammer catch 126 is configured to hold hammer 64 in the hammer cocked position so long as primary sear 120 remains in the primary sear cocked position.

In the embodiment of FIG. 5, slide pivot mount 122 is slidably mounted to primary sear pivot 124 and is slidably movable within a range of positions closer or farther away from valve stem 46 and primary sear bias leg 113 is configured to urge primary sear 120 in this direction.

Interaction between slide pivot mount 122 and primary sear pivot 124 also limits an extent to which primary sear 120 can be slidably moved by hammer 64 toward valve stem 46 in the cocked state However, this interaction does not constrain primary sear 120 from rotating along a first hammer catch movement path 130 about primary sear pivot 124 to an extent sufficient to move hammer catch 126 out of hammer path 68.

Instead in this embodiment, hammer 64 and hammer catch 126 are configured to engage in a manner that causes hammer catch 126 to rotate in first direction 161 along first hammer catch movement path 130 until hammer catch 126 no longer prevents hammer 64 from traveling along hammer path 68 to strike valve stem 46. For example, and without limitation, in this embodiment, hammer 64 has a hammer face 67 that is configured generally normal to a hammer path 68 with a tapered edge 72 confronting a generally complimentarily inclined hammer catch 126 so that when hammer spring force SF drives hammer face 67 along hammer path 68 toward valve 40, hammer face 67 interacts with hammer catch 126 to urge primary sear stop surface 128 of primary sear 120 to rotate in first direction 161 along a first hammer catch movement path 130. Other mechanical arrangements can be used so to accomplish this result.

As is shown in FIG. 6, a secondary sear 140 is used control whether primary sear 120 can rotate along first hammer catch movement path 130 in response to the interaction of hammer face 67.

In FIG. 6, secondary sear 140 is shown in a cocked position and has a secondary sear pivot mount 142, a head portion 150 and a tail portion 158. Secondary sear pivot mount 142 is mounted about a secondary sear pivot 144 for movement within a range of positions including the position shown in FIG. 2 where secondary sear 140 blocks primary sear 120 from rotating in response to forces applied by hammer 64 against hammer catch 126.

Also shown in FIG. 6 are an optional first direction limiter 160 that limits an extent of rotation of a head portion 150 secondary sear 140 in a first direction 161. In this embodiment, first direction limiter 160 has set spring mounting 162 which positions a set spring 164 in a head rotation path 166 of head portion 150 of secondary sear 140 as secondary sear 140 is rotated about secondary sear pivot 144 in first direction 161. Set spring mounting 162 and set spring 164 are configured and positioned so that when head portion 150 of secondary sear 140 reaches a first position in head rotation path 166 of head portion 150, set spring 164 begins resisting rotation in the first direction so as to provide generally monotonically increasing resistance against first direction rotation of head portion 150 until sufficient force is applied to block further movement of head portion 150 along head rotation path 166 in first direction 161.

Further shown in FIG. 6 is one embodiment of a second direction limiter 170. In this embodiment, second direction limiter 170 has a set screw mounting 172 which positions a set screw 174 to control an extent of rotation of tail portion 158 in a second direction 163 along a tail rotation path 176 when secondary sear 140 is rotated to cause such movement of tail portion 158. Set screw mounting 172 and set screw 174 are configured and positioned so that when tail portion 158 of secondary sear 140 moves in a first direction along tail rotation path and reaches a first position in a tail rotation path 176, a portion of set screw 174 blocks further movement of tail portion 158.

Either of first direction limiter 160 and second direction limiter 170 may, optionally be adjustable by a user or service technician and airgun 10 may provide for example exterior passageways to first direction limiter 160 and second direction limiter 170.

In this embodiment, secondary sear 140 has a lift pivot 184 shown in this embodiment linked for movement with tail portion 158.

A lift 180 has a lift pivot mount 182 joined to a lift pivot 184 for pivotal movement about lift pivot 184. Lift pivot 184 is also joined to tail portion 158 of secondary sear 140. Accordingly, tail portion 158 of secondary sear 140 rotates about lift pivot 184 when lift 180 is moved relative to secondary sear pivot 144 and does not rotate about secondary sear pivot 144 when lift 180 is moved.

Lift 180 has a lift notch 186 shaped and positioned relative to lift pivot 184 to engage trigger tab 112 for movement therewith as trigger 100 is moved to transition action 70 from the cocked position to fire airgun 10.

Figure 7:
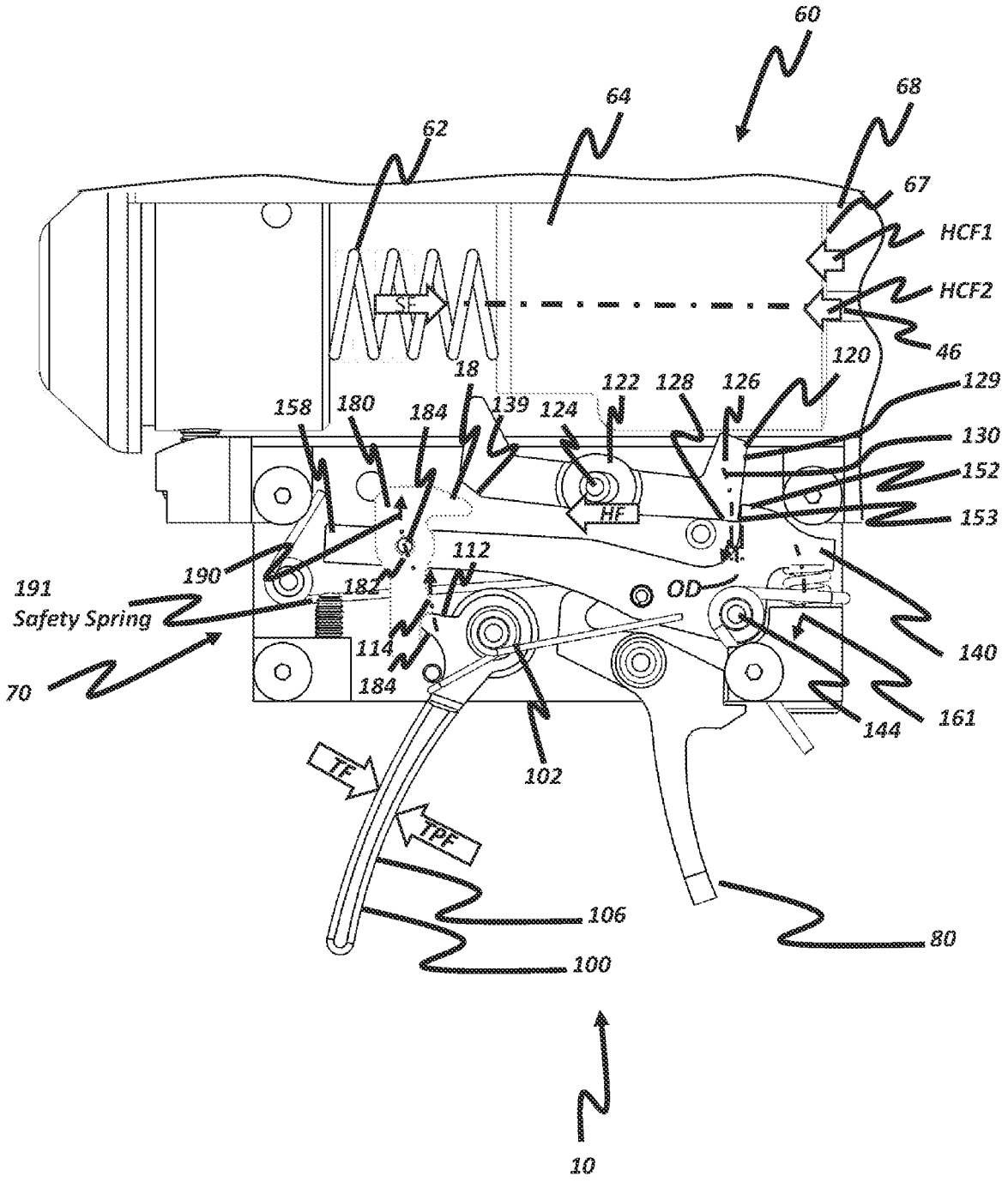
FIG. 7 is a right side cutaway cross-section view of the action of FIG. 5 with a trigger in a cocked state and a safety disengaged, a trigger in a fired position and a hammer is advanced to a position where the spring force and the cocking force are generally equal ending motion of the hammer in a firing direction.

FIG. 7 shows a right side cut-away enlarged cross-section view of airgun 10 showing primary sear 120, slide pivot mount 122, primary sear pivot 124, and a cut away view of secondary sear 140, secondary sear pivot mount 142, secondary sear pivot 144, head portion 150 and secondary sear stop surface 152 all in their respective cocked positions.

As is shown in FIG. 7, slide pivot mount 122 has a first end 132 and a second end 134 that are shown optionally shaped generally to conform to a shape of primary sear pivot 124. First end 132 is separated from second end 134 by a slide distance SD that is greater than a diameter D of primary sear pivot 124.

In the cocked state, spring force SF presses hammer 64 against hammer catch 126 urging primary sear 120 to slide so that first end 132 is brought into contact with primary sear pivot 124.

Primary sear pivot 124 provides holding force HF to resist further movement of primary sear 120 toward valve stem 46. It will also be observed when first end 132 of slide pivot mount 122 positioned against primary sear pivot 124 as shown, primary sear 120 is positioned to rotated about primary sear pivot 124 along a first hammer catch movement path 130 that overlaps secondary sear stop surface edge 153 by an overlap distance OD to block primary sear stop surface 128 from moving in the first direction 161 along first hammer catch movement path 130 when primary sear 120 and secondary sear 140 are in the cocked position.

In embodiments overlap distance OD can be equal to the difference between a diameter D of primary sear pivot 124 and slide distance SD. In embodiments overlap distance OD can be less than the difference between a diameter D of primary sear pivot 124 and slide distance SD.

In this configuration, secondary sear 140 blocks rotation of primary sear 120 in a first direction along first hammer catch movement path 130 until secondary sear stop surface 152 is moved from the cocked position to a fired position. Secondary sear 140 is biased toward the cocked position by a secondary sear biasing member 154.

FIG. 8 shows a right side cut-away view of hammer system 60 and action 70 of FIG. 1 after hammer system 60 and action 70 have reacted to movement of trigger 100 a trigger fired position. As is shown in FIG. 8, when a user applies a trigger pull force (TPF) that is greater than a trigger force (TF) against trigger control surface 106, trigger 100 moves from a trigger non-fired position shown in FIGS. 7 and 8, to the fired position shown here in FIG. 9.

When trigger 100 moves into the fired position, trigger tab 112 moves in a first direction along trigger tab path 114 while remaining engaged with trigger tab 112. Accordingly, movement of trigger 100 from the cocked position to the fired position has the effect of urging lift 180 to move along a lift path 190.

Additionally, as lift 180 is joined to tail portion 158 of secondary sear 140, movement of lift 180 along lift path 190 causes secondary sear 140 to rotate about secondary sear pivot 144. This rotation drives secondary sear stop surface 152 out of first hammer catch movement path 130 to permit rotation of primary sear 120 from the cocked position to a fired position. Here this occurs when secondary sear 140 is rotated so that secondary sear stop surface edge 153 is advanced toward valve stem 46 by at least an overlap distance OD.

In this embodiment, primary sear stop surface 128, a primary sear side surface 129 and secondary sear stop surface edge 153 are shaped and positioned so that hammer 64 can quickly rotate hammer catch 126 out of hammer path 68 to strike valve stem 46 as is described in greater detail above.

As is shown in FIG. 8, and as discussed in greater detail above, a first hammer cocking force HCF1 is provided by cocking flow 57 and a second portion of hammer cocking force HCF2 is provided by valve stem 46 against hammer 64 to thrust hammer 64 away from valve stem 46 and at the point illustrated the sum of first hammer cocking force HCF1 and second hammer cocking force HCF2 exceed the spring force SF applied by hammer spring 62 such that hammer 64 can then be thrust back toward the cocked position.

FIG. 8 shows a right side cut-away view of airgun 10 of the embodiment of FIG. 1, after the first hammer cocking force (not shown in FIG. 8) and the second cocking force (not shown in FIG. 8) have been applied to hammer 64 for a period of time sufficient to thrust hammer 64 in a cocking direction along hammer path 68 to impart a hammer cocking kinetic energy HCKE to hammer 64. The hammer cocking kinetic energy HCKE is sufficient to overcome the spring force SF experienced by hammer 64 as hammer 64 over the range of positions traveled by hammer 64 in returning to the cocked position.

It will be observed that as hammer 64 is moved toward hammer spring 62, hammer 64 passes hammer catch 126. Hammer catch 126 is rotated out of hammer path 68 as hammer 64 travels toward valve stem 46 during firing and may remain in this condition so that hammer 64 can pass hammer catch 126 on its return to the cocked position without contact.

However, it will also be observed that in this embodiment, primary sear can rotate freely about primary sear pivot 124 when trigger 100 is in the fired position. Accordingly, in certain instances it might be possible for primary sear 120 to move, at least in part, back into hammer path 68 before hammer 64 moves past hammer catch.

In embodiments, hammer catch 126 can have a hammer catch deflection surface 127 shaped to interact with a return surface 74 of hammer 64 so that return surface 74 will drive hammer catch 126 out of hammer channel 68 in the event that primary sear 120 is positioned with hammer catch 126 in such a location as hammer 64 returns toward the cocked position. The use of a hammer catch deflection surface 127 beneficially ensures that hammer catch 126 is not damaged by movement of hammer 64 in such circumstances and that interactions with hammer catch 126 do not consume so much of hammer cocking kinetic energy HCKE as to prevent hammer 64 from returning to a position allowing hammer to be held in the cocked position.

However, for hammer 64 to be held at the cocked position, it is necessary that action 70 returns to the cocked configuration before hammer 64 is thrust by valve spring force VSF past hammer catch 126. To ensure proper timing or sequencing of this it is important to trigger the process of returning action 70 to the cocked configuration when hammer 64 is within a certain range of positions within hammer path 68.

Accordingly, in the embodiment illustrated, primary sear 120 also has a primary sear return surface 138 that enters hammer path 68 and engages hammer 64 when hammer 64 is within a range of positions in hammer path 68 as hammer 64 is cocked. This engagement causes action 70 to begin the process of returning to the cocked configuration so that this process is complete when necessary to hold hammer 64 in the cocked position.

In this embodiment, primary sear 120 is configured and mounted so that when primary sear return surface 138 is positioned in hammer path 68, primary sear return surface 138 is positioned to receive energy from hammer 64 and can cause this energy to be used to rotate primary sear 120 to move hammer catch 126 into hammer path 68.

Conversely, hammer catch 126 is configured so that when primary sear 120 is released from engagement with secondary sear stop surface 152 rotation of primary sear 120 is permitted along first hammer catch movement path 130. During firing, engagement between hammer face 67 and hammer catch deflection surface 127 urges hammer catch 126 out of hammer path 68, while also urging primary sear return surface 138 into hammer path 68. Here this is accomplished by positioning primary sear return surface 138 on an opposite side of slide pivot mount 122 from hammer catch 126.

Figure 9:
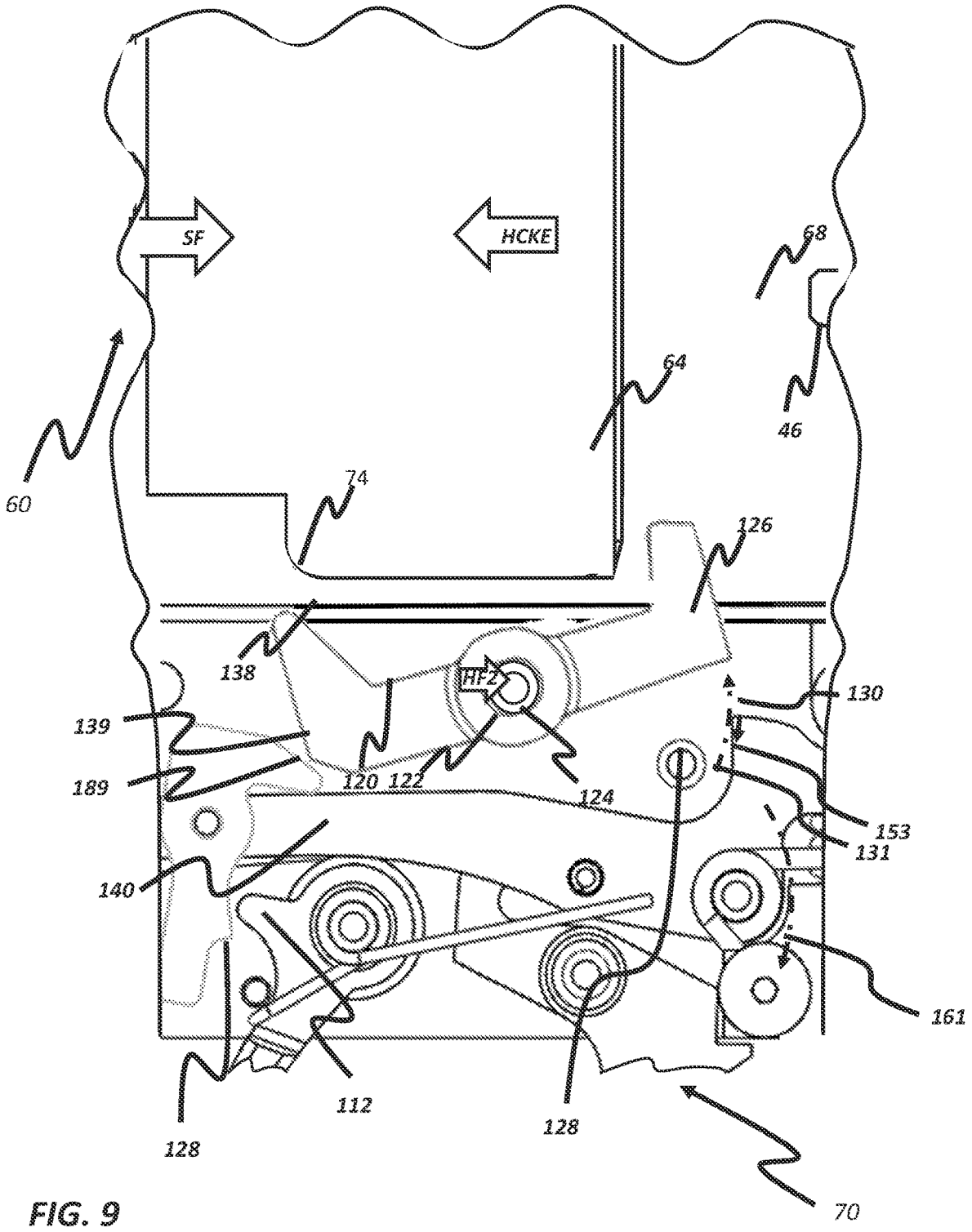
FIG. 9 is a right side cutaway cross-section enlarged view of portions of a hammer system and the action of FIG. 5 as hammer is advanced toward a return position where the spring force and the cocking force are generally equal ending motion of the hammer in a cocking direction.
Figure 10:
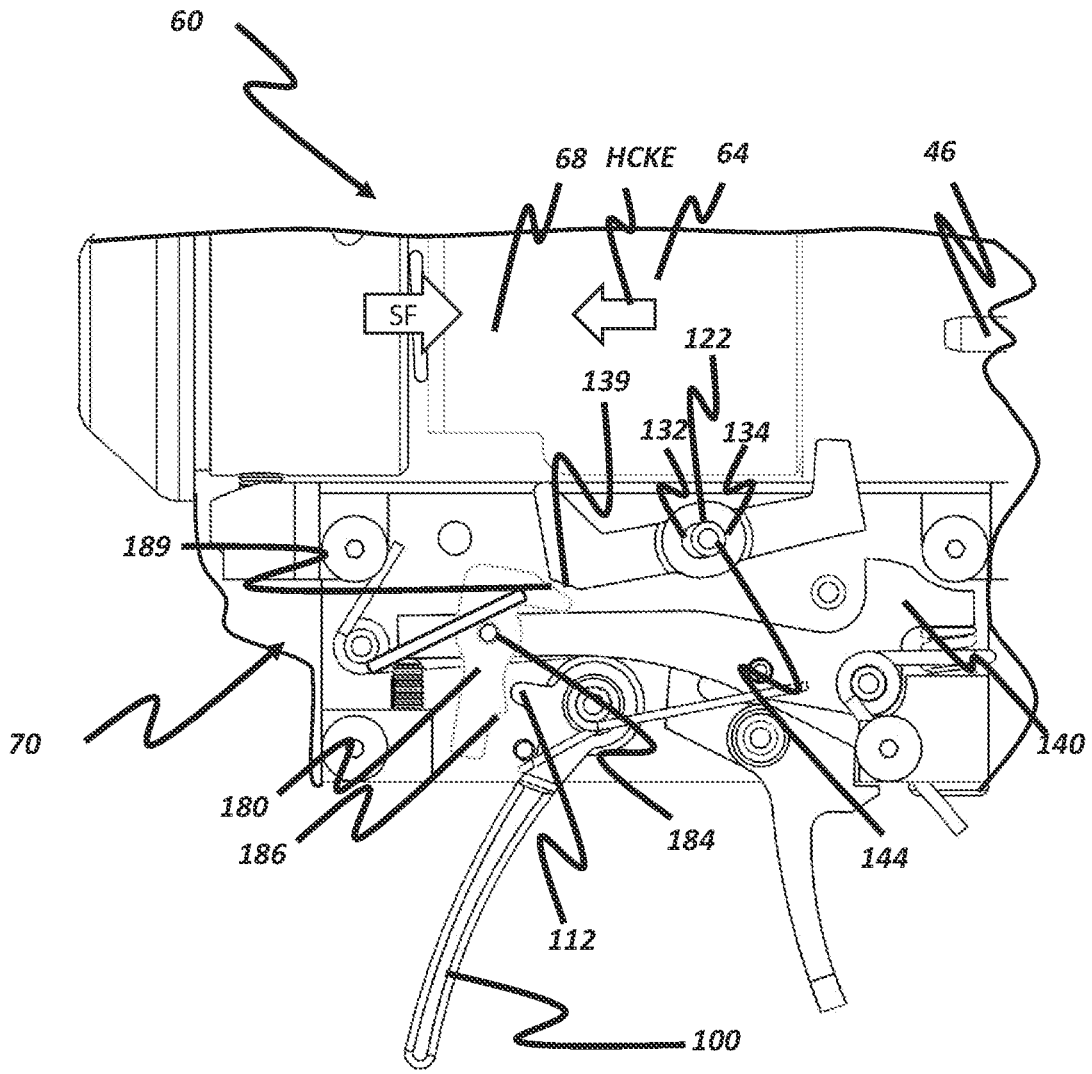
FIG. 10 is a right side cutaway cross-section enlarged view of portions of a hammer system and the action of FIG. 5 as a hammer is advanced from a return position toward the fired position

This process will now be described with reference to FIGS. 9 and 10. FIG. 9 is a right side cutaway cross-section enlarged view of portions of hammer system 60 and the action 70 of FIG. 6 as hammer 64 moves in the cocking direction into contact with a deflection surface of a primary sear. FIG. 10 is a right side cutaway cross-section enlarged view of portions of hammer system 60 and action 70 of FIG. 6 as hammer 64 is advanced toward a return position where the spring force SF and the cocking force CF are generally equal ending motion of hammer 64 in a cocking direction.

As is shown in FIGS. 9 and 10, hammer 64 has a return surface 74 positioned to receive and be moved by primary sear return surface 138 as hammer 64 moves in the cocking direction along hammer path 68. Hammer return surface 64 and primary sear return surface 138 are co-designed so interaction between these surfaces causes action 70 to begin the process of returning to the cocked configuration.

In this embodiment, hammer return surface 74 is curved and primary sear return surface 138 is inclined so that hammer return surface 74 interacts with primary sear return surface 138 to urge primary sear 120 to slide and pivot as will be described presently.

The sliding motion caused by this interaction drives primary sear pivot mount 122 to move to bring second end 134 of slide pivot mount 122 into contact with pivot 124. Pivot 124 blocks such movement by generating a second holding force HCF2 that overcomes forces created by the interaction of return surface 74 and primary sear return surface 138.

It will also be observed in FIG. 10 that when second end 134 of slide pivot mount 122 is positioned against primary sear pivot 124 as shown, primary sear 120 is no longer positioned so that primary sear stop surface 128 rotates about primary sear pivot 124 along first hammer catch movement path 130 but rather such rotation occurs along a primary sear return path 131 which is separated from first hammer catch movement path 130 by an offset distance that can provide a desired amount of clearance between primary sear 120 and secondary sear 140 as primary sear 120 rotates.

The rotation of primary sear 120 repositions hammer catch 126 in hammer path 68 and can remove primary sear 120 from a position that may interfere with rotation of secondary sear 140 into first hammer catch movement path 130.

The rotation of primary sear 120 also brings primary sear face 139 into contact with lift ramp 189. This contact causes lift 180 to rotate in a manner that disengages trigger notch 186 from trigger tab 112. This separation permits secondary sear 140 to rotate in response to the urging of a lift spring 194 until lift 180 is brought to a rest position against positioning pin 103.

In embodiments other arrangements can be used to cause at least one of primary sear 120 and secondary sear 140 to move relative to the other of primary sear 120 and secondary sear 140 to provide a primary sear return path 131 that is different from a first hammer catch movement path 130. In embodiments, it may not be necessary to provide for such sliding motion of primary sear 120.

In embodiments, at least one of primary sear 120 and secondary sear 140 can move relative to the other of primary sear 120 and secondary sear 140 along non-linear paths and paths that at least in part are not substantially parallel to hammer path 68.

In general, hammer 64 reaches the return position as hammer 64 exhausts the hammer cocking kinetic energy to a point where hammer 64 is no longer capable of generating more force than hammer spring 62 exerts against hammer 64. This occurs when there is spring force SF in resisting movement of hammer 64 than hammer 64 can generate with remaining hammer cocking kinetic energy (HCKE). In the example embodiment shown in FIG. 10, this point occurs when hammer 64 has been moved in the cocking direction past the fired position shown in FIG. 6.

Afterward, spring force SF ultimately overcomes cocking force CF causing hammer 64 to move from the position shown in FIG. 9 to the position shown in in FIG. 10 and thence to the position shown in FIG. 5.

Primary sear 126 As hammer 64 is first driven into contact with hammer 64 first urges primary sear 120 to slide to bring first end 132 of slide pivot mount 122 into contact with primary sear pivot 124. This, in turn, positions primary sear to rotate about primary sear 120 along first hammer catch movement path 130. Subsequently hammer 64 then acts against hammer catch 126, which urges primary sear 120 to slide forward to the extent that the bias applied by trigger spring has not already done so and to rotate along first hammer catch movement path 130 as described above in FIG. 5.

As is also described in FIG. 5, this movement is now blocked by the presence of secondary sear 140 in hammer catch movement path 130 until trigger 100 is rotated by action of trigger return spring 111 until trigger tab 112 again engages trigger notch 186. This can occur when a user releases trigger 100 or reduces the amount of trigger pull force on trigger 100.

Referring again to FIG. 3 FIG. 3, hook 92 of safety 80 is positioned and configured to be movable between a disengaged position separated from secondary sear 140 and an engaged position shown in FIG. 1 where hook 200 engages a co-designed feature 202 on secondary sear 140 preventing secondary sear 140 from being moved so as to move secondary sear stop surface 152 from first hammer catch movement path 130.

Figure 11:
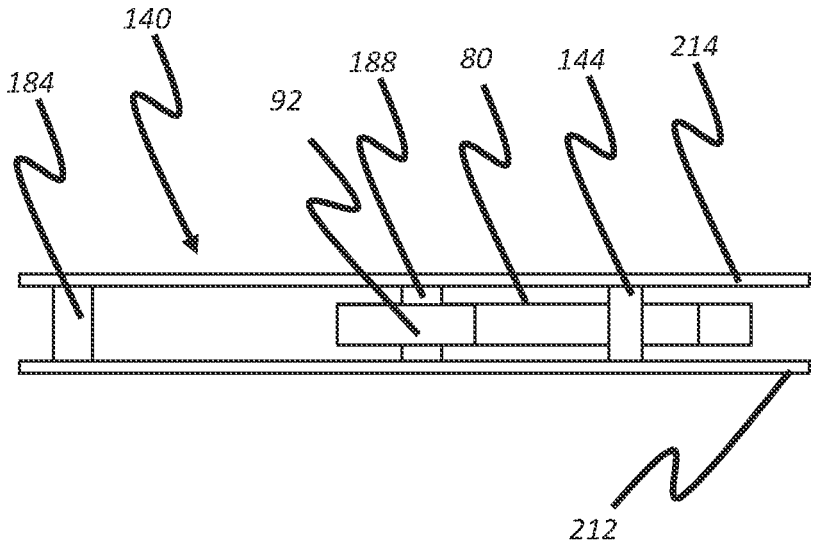
FIG. 11 shows a top view of one embodiment of a secondary sear and a portion of a safety.

FIG. 11 shows a top view of one embodiment of a secondary sear 140 and a portion of safety 80. In this embodiment, secondary sear 140 comprises a right wall 212 and a left wall 214 joined by lift pivot 184, secondary sear pivot 144 and a post 210. In this embodiment, lift pivot 184 is positioned to be engaged by hook 92 so that rotation of secondary sear about secondary sear pivot 144 is blocked when safety 80 is in the engaged position.

In this way, a gas powered fire control system 70 is provided that can discharge a generally predetermined amount of pressurized gas sufficient to thrust a projectile 26 down bore 16 toward a target. Further, when the user moves trigger 100 to the fired position, the gas powered fire control system 70 automatically returns to a state from which it is prepared to discharge a second generally predetermined amount of pressurized gas.

Action: Second Embodiment

Figure 12:
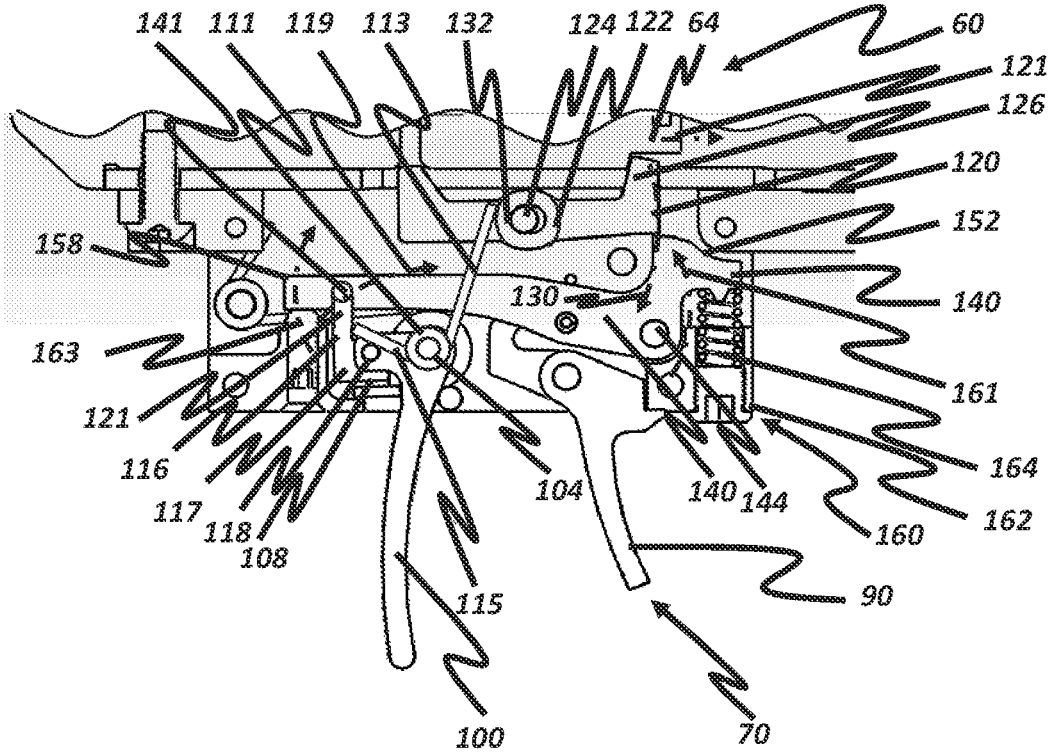
FIG. 12 is a right side cutaway cross-section view of the airgun of FIG. 1 having a first embodiment of an action in a cocked state and a safety engaged.
Figure 13:
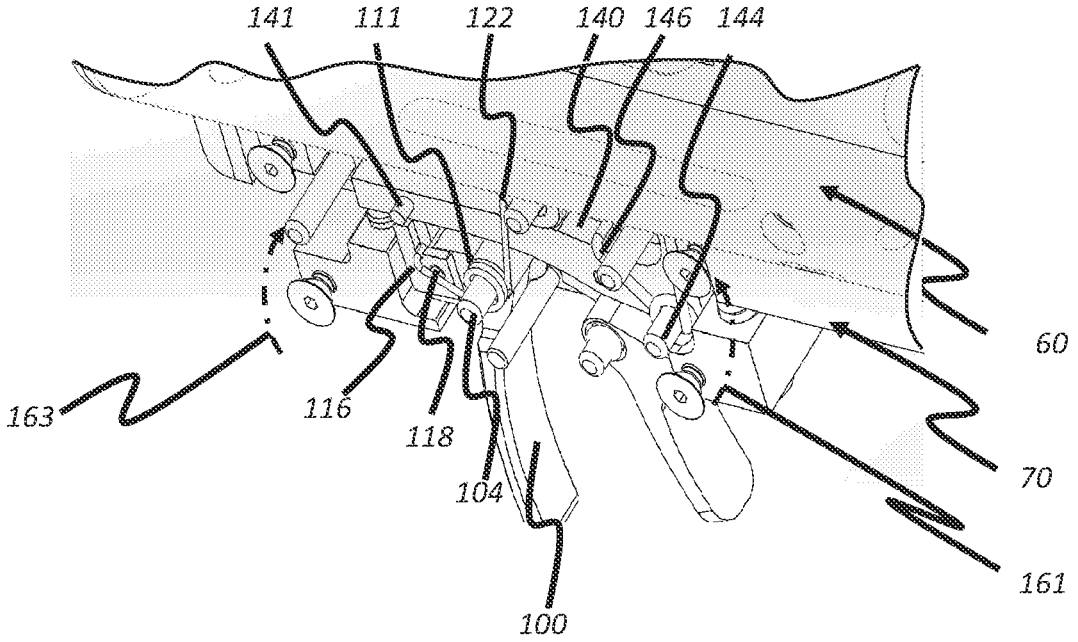
FIG. 13 is a front, right, top perspective cutaway view of the embodiment of action of FIG. 13 with a portion of a secondary sear removed.

FIG. 12 is a right side view of another embodiment of action 70 with a portion of secondary sear 140 removed and a secondary sear spring removed to better illustrate the concepts described while FIG. 13, is a front, right, top perspective view of the embodiment of action 70 of FIG. 12.

In this embodiment, a trigger 100 is mounted about a trigger pivot 104 and is joined to a first end 117 of lift 116 by a trigger lift pivot 118.

A trigger return spring 111 is also mounted about trigger pivot 104. Trigger return spring 111 has a primary sear bias leg 113, and a trigger reset contact leg 115 that urges lift 116 to rotate about trigger lift pivot 118 in a direction that brings a first end 117 into contact with a trigger stop 108. When first end 117 is in contact with trigger stop 108, such urging then serves to urge trigger 100 away from the fired position.

In this embodiment, and as is generally described above, primary sear 120 is slidaby and pivotably mounted to a primary sear pivot 124 and has a hammer catch 126 that holds hammer 64 at a cocked position shown in FIG. 12. Primary sear 120 is rotatable about a first hammer catch movement path 130 and hammer catch 126 can be rotated out of the cocked position to release hammer 64 for firing as generally described above.

In this embodiment, primary sear bias leg 113 optionally presses against slide pivot mount 122 of to urge primary sear 120 along primary sear pivot 124 so that hammer catch 126 is positioned to rotate about a first hammer catch movement path 130.

As is also generally described above, secondary sear 140 is provided that is rotatable in a second direction 163 about a secondary sear pivot 144 from a position where secondary sear 140 blocks rotation of primary sear 120 along first hammer catch movement path 130 thus preventing hammer 64 from passing hammer catch 126 unless secondary sear 140 is moved from first hammer catch movement path 130.

A first direction limiter 160 is shown here in the form of a set spring mounting 162 and set spring 164. Set spring 164 applies increasing force urging secondary sear 140 to rotate in first direction 161 to effectively limit movement of primary sear 120 in second direction 163.

A secondary sear engagement surface 141 is associated with secondary sear 140 such that movement of secondary sear engagement surface 141 causes, in this embodiment, pivotal movement of secondary sear 140. Secondary sear engagement surface 141 thus is movable along an arcurate secondary sear engagement surface path 143 about secondary sear pivot 144. Here, secondary sear engagement surface 141 is positioned on a tail portion 158 of secondary sear 140 however in other embodiments secondary sear engagement surface 141 can be located elsewhere.

As is shown in FIGS. 12 and 13, trigger reset lift 116 positioned by trigger 100 so that a second lift end 123 of trigger reset lift 113 is in contact with secondary sear engagement surface 141 when trigger 100 is in a range of positions including a range of non-fired positions.

As is shown in FIG. 13, an optional secondary sear spring 146 provides a bias that urges secondary sear 140 to rotate in first direction 161 so as to bias secondary sear engagement surface 141 to remain in engagement with second lift end 123 of trigger lift 113.

To fire airgun 10, a user pulls trigger 100 through the range of non-fired positions. This causes rotation of trigger 100, which, in turn causes rotation of trigger reset lift 116 along a trigger lift path 119. Here trigger lift path 119 extends in an arcurate manner about trigger pivot 104.

Figure 14:
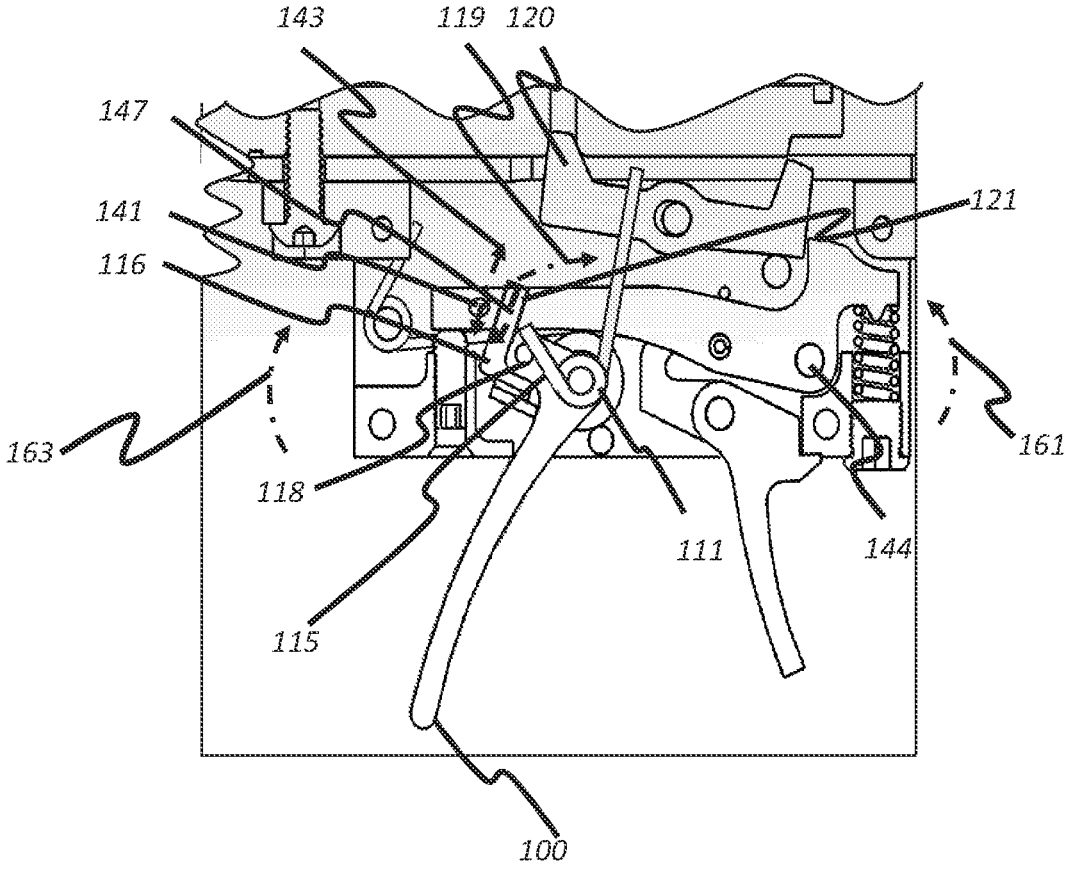
FIG. 14 is a right side cutaway cross-section enlarged view of portions of a hammer system and the action of FIG. 6 as the hammer travels toward the hammer return position and engages primary sear.

As can be seen in FIG. 14, the secondary sear engagement surface path 143 and trigger lift path 119 are generally coincident as trigger 100 is moved through a first range positions. Thus moving trigger 100 through this first range of positions causes secondary sear 140 to move in second direction 163. Ultimately this moves secondary sear 140 to a position that does not block movement of primary sear 120 along hammer catch movement path 130 releasing hammer 64 and firing airgun 10.

Once primary sear 120 is released from this constraint, forces such as those applied by hammer spring 62 and hammer 64 against hammer catch 126 drive primary sear 120 to rotate out of hammer path 68 allowing hammer 64 open and close valve 40

Additionally, as is shown in FIG. 14, at or after trigger 100 is pulled to the fired position, secondary sear engagement surface path 143 diverges from trigger lift path 119 to an extent sufficient to cause second lift end 123 of lift 116 to separate from secondary sear engagement surface 141.

When this occurs, secondary sear spring 146 urges secondary sear 140 to rotate in first direction 161 returning secondary sear engagement surface 141 to the position shown in FIGS. 12 and 13.

Ultimately, described in greater detail above, hammer 64 returns along hammer path 68 and strikes primary sear return surface 138. This drives, driving primary sear 120 so that secondary sear 140 can be rotated in the first direction 161 and again be positioned to hold primary sear 120 in a position where hammer catch 126 will hold hammer 64 in the cocked position.

Trigger 100 must then be returned to the range of non-fired positions. When the user releases the trigger, trigger bias spring 110 urges lift 116 and trigger 100 to move toward the positions shown in FIGS. 12 and 13. However, at this point, second lift end 123 of lift 116 cannot follow trigger lift path 119 as secondary sear engagement surface 141 is pre-positioned in trigger lift path 119. However, as second lift end 123 contacts secondary sear engagement surface 141, lift 116 pivots against the bias of trigger reset spring leg 115 such that second lift end 123 follows a diversion path 147 around secondary sear engagement surface as trigger 100 is returned to the range of non-fired positions. As trigger 100 is further moved away from the fired position, the end of diversion path 147 is reached and trigger reset contact leg 115 of trigger spring 110 biases trigger reset lift 116 to return to trigger lift path 119 so that upon the next pull of the trigger, second lift end 123 is positioned to drive secondary sear engagement surface 141.

Reloading System

As noted above, semi-automatic operation of airgun 10 also conventionally implies that after a first one of the projectiles 26 is fired another is positioned for firing without user intervention. This is known as an automatic reloading process.

It is desirable that the automatic reloading process is performed at least in part during the time that hammer 64 is returned to a cocked position or the time that action 70 is returned to a firing configuration or both. This has the effect of reducing the amount of time required between the firing of one projectile 26 from airgun 10 and the firing of another projectile 26 from airgun 10.

Additionally, it is highly desirable that such a reloading process be capable of execution without necessary mechanical interaction with hammer system 60, without necessary mechanical interaction with action 70, without placing additional demands for compressed air from stored supplies and without detracting from the performance of other systems of airgun 10.

Further, it is preferred that such a process does not involve the use of additional electronic controls, electro-mechanical actuators, or mechanical subsystems that demand substantial increases in the complexity, cost or weight of airgun 10.

Figure 15:
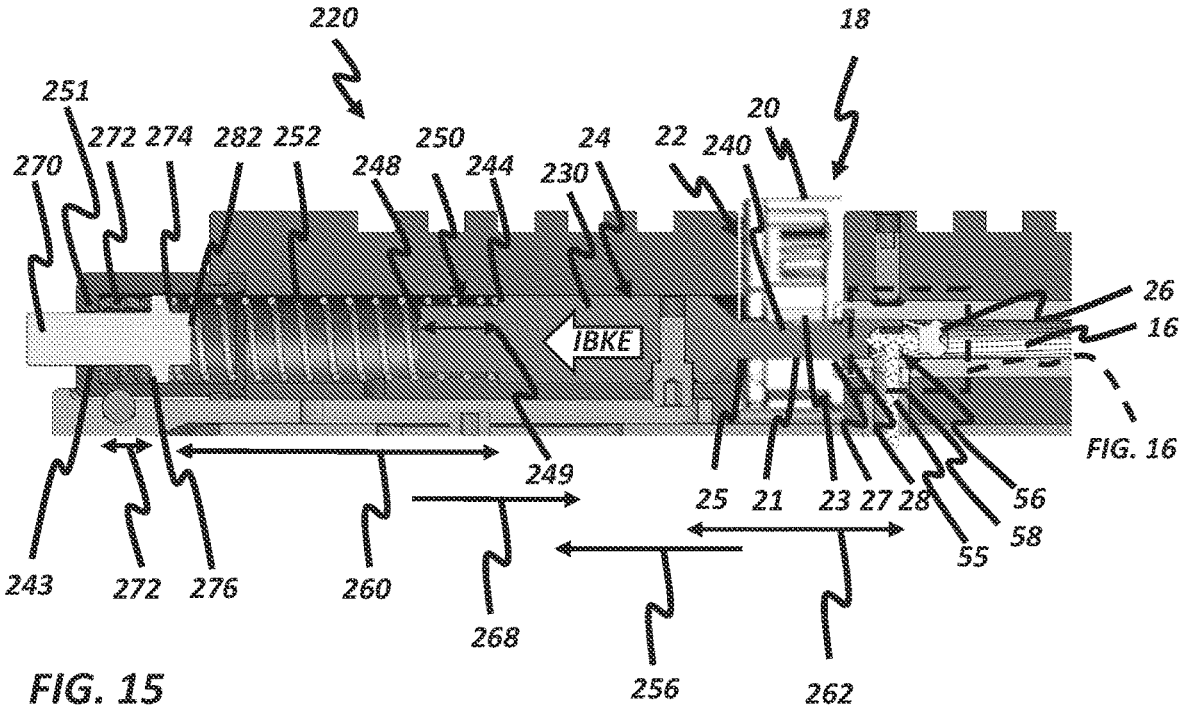
FIG. 15 is a right side cross-section view of one embodiment of a reloading system just after a trigger has been pulled to the fired position and with a bolt in a fired position.
Figure 16:
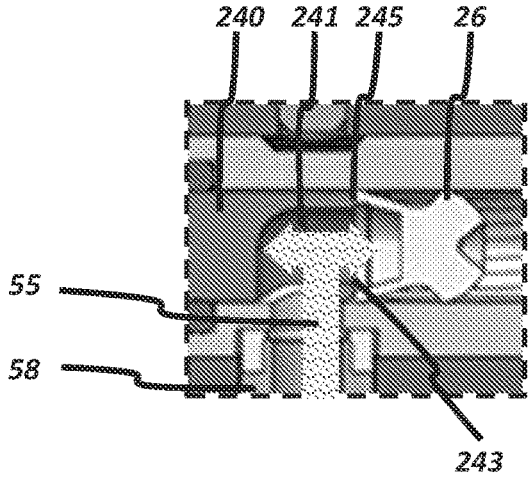
FIG. 16 is an enlarged view of an indicated portion of FIG. 15.
Figure 17:
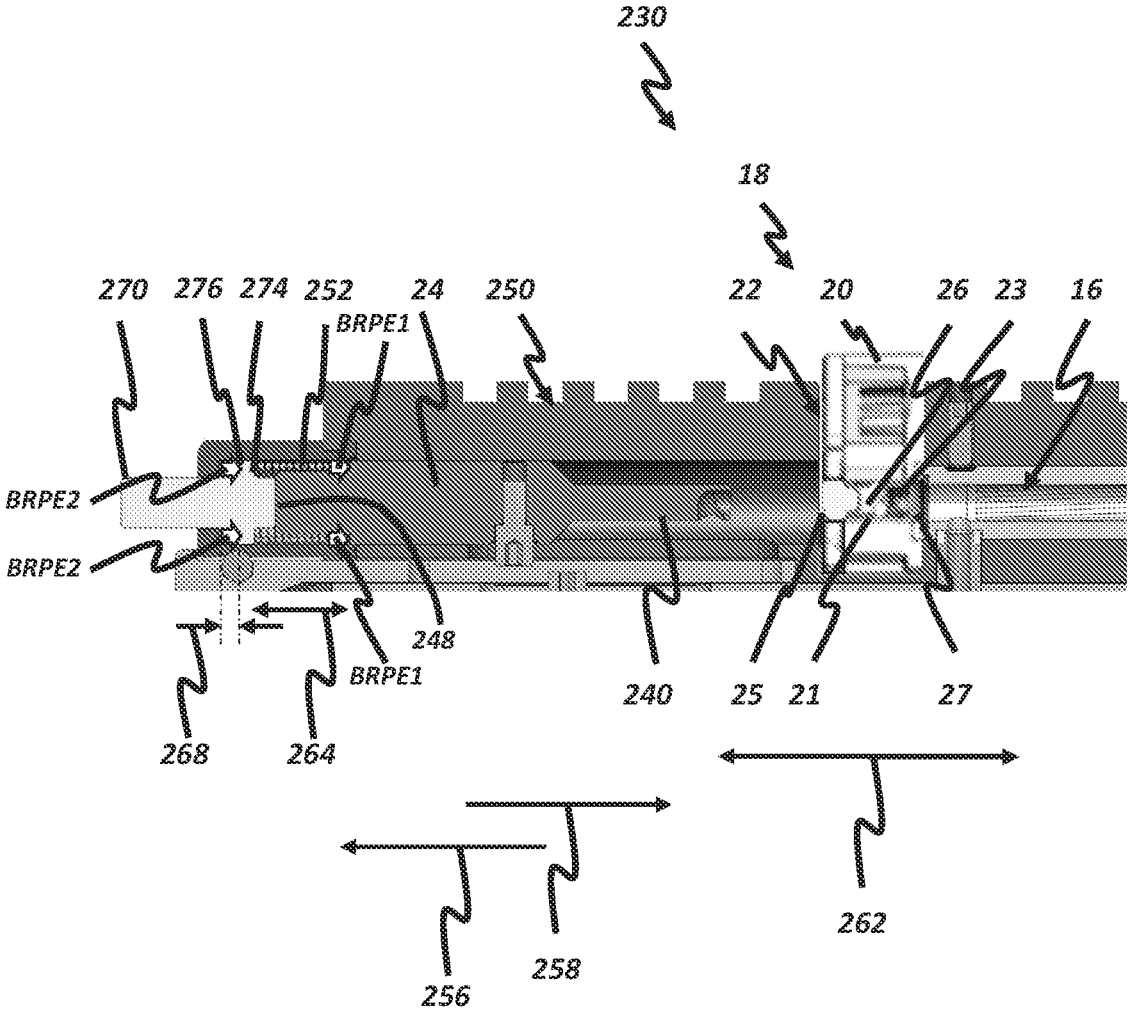
FIG. 17 is a right side cross-section and cutaway view of the embodiment of FIG. 15 with a bolt at a return position.
Figure 18:
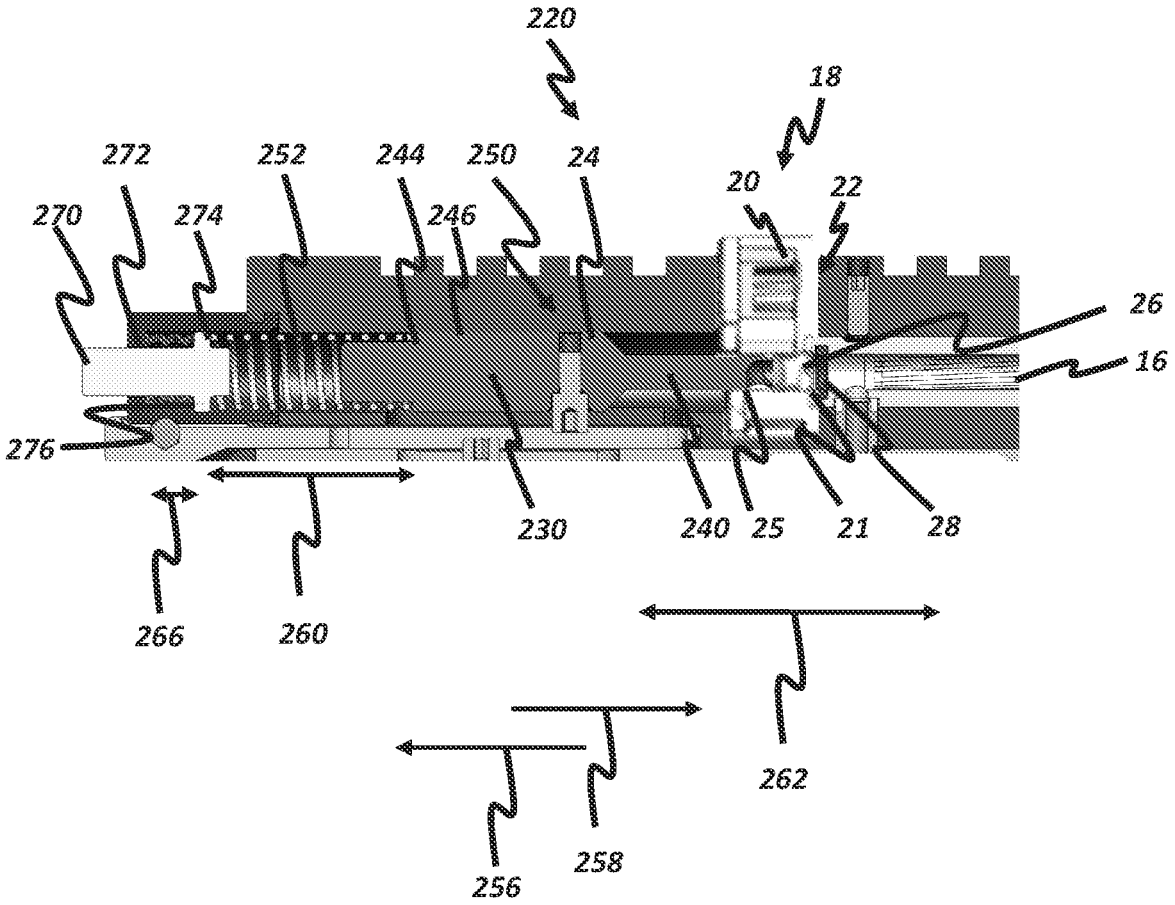
FIG. 18 is a right side cross-section and cutaway view of the embodiment of FIG. 1 with a bolt positioned to engage a projectile during loading.

The automatic loading process used by airgun 10 will now be described with reference to FIGS. 15-18. FIG. 15 is a right side cross-section cutaway view of the embodiment of airgun 10 of FIG. 1 with bolt 24 in a fired position. FIG. 16 is a right side cross-section view of one embodiment of a reloading system just after a trigger has been pulled to the fired position and with a bolt in a fired position. FIG. 16 is an enlarged view of an indicated portion of FIG. 16. FIG. 17 is a right side cross-section and cutaway view of the embodiment of FIG. 1 of airgun 10 with bolt 24 at a return position. FIG. 18 is a right side cross-section and cutaway view of the embodiment of FIG. 1 with bolt 24 positioned to engage a projectile 26 during loading.

As noted above, projectile loading system 18 has a holder 22 that holds a removable projectile storage system 20 and interacts with removable projectile storage system 20 so that one of plurality of projectiles 26 is positioned in a loading area 21 from which projectile 26 can be advanced to and through a bore 16 for firing.

Also as noted above, loading area 21 is shown located between a bolt side opening 25 of projectile storage system 20 and a bore side opening 27 of projectile storage system 20. In the embodiment shown, projectile storage system 20 and projectile storage system positioner 22 are configured so that loading area 21, bolt side opening 25, and bore side opening 27 are generally aligned with bolt tip portion 240 and bore 16 to permit at least a part of bolt 24 to pass into and out of loading area 21 when projectile storage system 20 is properly seated in or otherwise mechanically associated with projectile storage system holder 22.

In FIGS. 15-18, projectile storage system 20 has a plurality projectile holders 23 that are biased to move in a manner that causes a projectile 26 to positioned in loading area 21. Projectile storage system 20 is also configured so that such biased movement of projectile holders 23 can be blocked by the presence of a bolt 24 in loading area 21 and can also be blocked by the presence of a projectile 26 in loading area 21. Thus, during a reloading operation biased movement of projectile holders 23 to position a new projectile 26 can occur only when loading area 21 is clear of bolt 24 and must be completed before bolt 24 returns.

Movement of bolt 24 is constrained by a bolt drive system 220 which provides a bolt path 250 within which bolt 24 can move between the fired position shown in FIGS. 15 and 16, the return position shown in FIG. 17, and the engagement position shown in FIG. 18. Bolt 24 has a bolt body portion 230 with a bolt tip portion 240 extending from bolt body portion 230 by a predetermined length.

In the embodiment of FIGS. 15-18, bolt 24 is biased to move into the fired position by action of bolt drive system 220. In the embodiment illustrated, bolt drive system 220 comprises a resilient compression type bolt spring 252 that engages bolt 24 on a side of bolt body portion 230 opposite from a side on which bolt tip portion 240 is located. Other configurations are possible including but not limited to embodiments that make use of tension or other types of springs.

As is shown in FIG. 15, bolt tip portion 240 is sized and shaped to so that when bolt 24 is in the fired position, bolt tip portion 240 extends through bolt side opening 25, projectile holder 23, bore side opening 27, past a bolt seal 28 and into bore 16. Bolt seal 28 and bolt tip portion 240 are co-designed to create a releasable engagement that generally restricts the flow motive flow 55 in a direction away from projectile 26. Thus an accumulation volume 56 is formed between bore 16, bolt tip portion 240, projectile 26 and bolt seal 28 during firing.

As is best shown in FIG. 16, in the fired position, bolt tip portion 240 extends past transfer tube 58 and provides a channel 241 that permits motive flow 55 to pass in part along a portion of the length of bolt tip portion 240 to an opening 243 in a bolt face 245. Bolt face 245 is sized and shaped to engage a projectile 26 so that movement of bolt face 245 against projectile 26 can move projectile 26 as required to cause projectile 26 to be positioned for firing through bore 16.

In embodiments, bolt face 245 is sized to spread forces applied to projectile across a large diameter of the outer permitter of the projectile. This helps to distribute driving loads more evenly around the perimeter of the projectile and to reduce the possibility of misalignment of the pitch or yaw of projectile 26 with bore side opening 27, bolt seal 28 or bore 16 during loading.

As generally discussed above, when hammer 64 strikes valve stem 46 a motive flow 55 begins to flow into accumulation volume 56 where motive flow 55 is trapped between bore 16, projectile 26, bolt seal 28 and bolt tip portion 240. This creates a gas pressure against all surfaces forming accumulation volume 56. As motive flow 55 continues, this pressure rapidly increases until a firing pressure is reached wherein projectile 26 is thrust down bore 16 such that projectile 26 exits bore 26 with at least a minimum velocity.

To help ensure that the pressure in accumulation volume 56 builds to the firing pressure it is important that accumulation volume 56 does not substantially expand during a firing pressure accumulation period as motive flow 55 raises pressure in accumulation volume 56. Accordingly, it is known to fix the bolt of prior art airguns during the pressure accumulation period. Such airguns therefore cannot make effective use of the high pressures created during firing in the reloading process and require mechanisms to hold such prior art bolts in position during firing.

However, in airgun 10 a way has been found allow desirably high firing pressures to be reached in accumulation volume 56 during firing, and to do so without mechanisms that fix bolt 24 in place during such firing, while also allowing the high firing pressures to serve the dual purposes of firing projectile 26 through bore 16 and setting bolt 24 in motion for reloading.

Accordingly, bolt drive system 220 can be configured so that bolt 24 remains generally stationary for a period of time that is sufficient to allow motive flow 55 to supply the forces necessary to fire projectile 26 through bore 16 with desired velocities, while causing bolt 24 to retract from bore 16 and from projectile loading system 18 for a period of time sufficient to allow projectile loading system 18 and projectile storage system 20 to position a projectile 26 in a loading area 21 from which bolt 24 can then cause projectile 26 to be repositioned for firing from bore 16.

Further, bolt drive system 220 should accomplish these results without significantly adding to the cost, complexity or weight of airgun 10 or causing any significant increase in the amount of compressed gas to be used during firing and reloading.

An initial problem arises in the challenge of holding bolt 24 substantially in the fired position during firing while still permitting movement of bolt 24 during loading operations.

As projectile 26 and bolt tip portion 240 have similar if not identical cross sectional areas, the pressure created by motive flow 55 applies generally equivalent force against both bolt 24 and projectile 26. Ultimately, these forces overcome the resistance of bolt 24 and projectile 26 to movement.

One of the properties of both bolt 24 and projectile 26 that determines the resistance of bolt 24 and projectile 26 to movement is their resistance to changes in their state of motion. This is known as inertia. In general the inertia of an object is proportional to the mass of the object.

In this embodiment, bolt 24 is configured to have a substantially greater mass than projectile 26 and thus a greater resistance to a change in its state of motion than projectile 26. Bolt 24 is designed to have a mass that is many times larger than the mass of projectile 26. For example in embodiments, the mass of bolt 24 can be between 15 and 300 times the mass of projectile 26. In the embodiment illustrated, bolt 24 is about 40 to 50 times more massive than projectile 26. In other embodiments other ratios may be used.

Acceleration is governed by the following equation Acceleration=force/mass. Here, the forces acting on bolt 24 and projectile 26 are generally equal. Thus mass differences determine differences in the acceleration of each when the firing pressures peak and the amount of acceleration experienced by bolt 24 is about 40-50 times lower than that of projectile 26. In other embodiments the mass of the bolt can be between 20 and 400 times that of projectile 26.

Accordingly, during the critical few moments within which firing pressures are reached there is little or no movement of bolt 24 relative to projectile 26 as a product of the greater inertia that must be overcome to move bolt 24. Other factors such as friction, spring forces acting against bolt 24 and the need for projectile 26 to conform to bore 16 which may be rifled may influence the ultimate velocity of bolt 24 and projectile 26.

Afterward, movement of projectile 26 down bore 16 expands accumulation volume 56 at to an extent that significantly exceeds the extent of any expansion caused by movement of bolt 24. Thus, the effect of movement of bolt 24 on pressures experienced by projectile 26 becomes increasingly marginal as projectile 26 transits bore 16.

Further, the high force created by the firing pressures are used to overcome the resting inertia of bolt 24 and any other forces opposing movement of bolt 24 during firing causing bolt 24 to be driven in first direction 256 with a first direction inertia and an initial bolt kinetic energy that are then used to drive bolt 24 in a manner that enables reloading of a projectile 26 into bore 16 as will be described presently. Thus, the energy created by motive flow 55 is used both to accelerate bolt 24 and projectile 26 and additional demands for pressurized gas to enable reloading, if any, are not significant.

Additionally, in embodiments, the mass of bolt 24 is selected so that bolt 24 does not move past bolt seal 28 until projectile 26 is within a predetermined range of positions relative to an exit of bore 16.

As is shown in FIG. 18, motive flow 55 drives bolt 24 in a first direction 256 out of bore 16 and begins to drive bolt 24 out of loading area 21 in projectile loading system 18.

The initial bolt kinetic energy IBKE in first direction 256 must be drained so that bolt 24 can be returned in second direction 258 to the loading position.

In the embodiments of FIGS. 15-18, bolt drive system 220 draws down kinetic energy of bolt 24 as bolt 24 moves in first direction 256 stopping movement of bolt 24 in first direction 256 and storing a portion of the initial bolt kinetic energy IBKE as bolt return potential energy BRPE that can be released to return bolt 24 in second direction 258 so that a projectile 26 can be moved from loading area 21 by bolt 24.

As is shown in FIG. 17, bolt drive system 220 is also configured so that as bolt 24 travels to the return position, bolt 24 is moved into a range of positons where bolt 24 does not occupy loading area 21. This permits projectile loading system 18 to begin the process of moving at least one of the projectile holders 23 in projectile supply 20 so that a projectile 26 is positioned in loading area 21.

The process of moving a projectile 26 into loading area 21 requires some time to complete. Accordingly, bolt drive system 220 must provide a projectile positioning delay between the movement of bolt 24 in first direction 256 out of a projectile loading area 21 and movement of bolt 24 in second direction 258 into loading area 21.

Additionally, it is preferred that bolt 24 be returned through loading area 21 in the second direction 258 at a velocity that may be much lower than the velocity at which bolt 24 is initially moved in the first direction 256. This can be done so as to ensure that features of projectile 26 such as flexible skirt features on airgun pellets are not subject to potential damage as they are thrust by bolt 24 from loading area 21 and to ensure that projectile 26 is seated in a desired manner for firing.

Finally, it will be appreciated that such outcomes are to be achieved while managing the movement of a moving bolt 24 that has a significant mass and therefore a significant inertia and kinetic energy to manage.

In the embodiment that is illustrated in FIGS. 15-18, bolt drive system 220 enables such control over movement of bolt 24 using a combination of a bolt spring 252 and a buffer spring 272 and a forward assist 270.

In this embodiment, bolt path 250 has an end wall 251 with opening 243 through which a forward assist 270 is positioned and both bolt spring 252 and buffer spring 272 are shown as compressible coil springs.

Forward assist 270 has bolt spring positioner 274 sized and shaped to engage the coils of bolt spring 252 and bolt 24 has a bolt spring engagement surface 244 and sized and shaped to engage the coils of bolt spring 252. Bolt spring 252 is positioned in bolt path 250 between bolt spring engagement surface 244 and the coils of bolt spring 252 to provide a resilient bias force urging bolt 24 away from bolt spring positioner 274.

Bolt 24 also has a forward assist engagement surface 248 that extends in first direction 256 away from bolt spring engagement surface 244 by a predetermined length 249 about which resilient compression type bolt spring 252 can be positioned and which provides an optional spring guide surface for bolt spring 252.

Forward assist 270 further has a buffer spring positioner 276 sized and shaped to engage the coils of buffer spring 272 at one end while end wall 251 is sized and shaped to engage the coils of buffer spring 272 at the other end. Buffer spring 272 is positioned in bolt path 250 between bolt spring engagement surface 244 and the coils of bolt spring 252 to provide a resilient bias force urging buffer spring positioner 276 away from end wall 251.

As bolt 24 begins to move in first direction 256 after firing, bolt spring 252 resiliently resists movement of bolt 24 in first direction 256. Bolt spring 252 has a bolt spring rate and is configured to be compressed from a first bolt spring length 260 (FIG. 15) to a second bolt spring length 264 (FIG. 17) and to convert a first portion of the initial bolt kinetic energy IBKE in first direction 256 into a first part of a first bolt return potential energy BRPE1 stored in bolt spring 252.

Buffer spring 272 resiliently resists movement of buffer spring positioner 276 toward end wall 251 as may be caused by forces created by forces applied by bolt spring 252 against bolt spring positioner 274 or forward assist engagement surface 248 against forward assist 270 as bolt 24 is moved in the first direction 256.

In this embodiment, buffer spring 272 is compressed from a first buffer spring length 266 (FIG. 16) to a second buffer spring length 267 (FIG. 19) and to convert a second portion of the initial bolt kinetic energy IBKE in first direction 256 into a second part of a bolt return potential energy BRPE and to apply force decelerating bolt 24 in first direction 256.

In this embodiment, the spring rate of buffer spring 272 is significantly higher than the spring rate of bolt spring 252.

Accordingly, in this embodiment, during a first portion of the movement of bolt 24 in first direction 256 there is more compression of bolt spring 252 than of buffer spring 272 and less resistance to movement of bolt 24 allowing bolt tip 240 to rapidly clear loading area 21 allowing reloading to begin.

As bolt 24 continues movement in first direction 256, the separation between bolt spring engagement surface 244 and bolt spring positioner 274 continues to close. Ultimately, this separation closes to a point where either bolt spring 252 reaches a compression level where further movement of bolt 24 in first direction 256 is primarily resisted by deflection of buffer spring 272 or where forward assist engagement surface 248 contacts forward assist 270 so that compression of bolt spring 252 ceases. Thus in this embodiment the second bolt spring length 264 is generally equal to the predetermined length 249 plus any length between a bolt spring engagement surface 282 and bolt spring positioner 274.

Buffer spring 272 has a spring rate that is selected to allow buffer spring 272 to reverse the direction of bolt 24 over a period of time that reduces the shock and vibration experienced within airgun 10 as movement of bolt 24 in first direction 256 is brought to an end.

Buffer spring 272 also has a spring rate that is selected to store a second bolt return potential energy BRPE2 in buffer spring 272 that is sufficient to, in combination with first bolt return potential energy BRPE1 to drive bolt 24 from the return position shown in FIG. 17 to the loading position shown in FIG. 18 and to a fired position shown in FIGS. 15 and 16.

In embodiments, the spring rate of buffer spring 272 is selected at least in part to extend the amount time that projectile supply system 18 has to load a new projectile 26 into loading area 21 for a given distance of travel of bolt 24 in bolt path 250.

That it is in some embodiments the use of a buffer spring can be avoided by using an extended length bolt spring or by allowing a rigid structure such as end wall 251 to absorb any kinetic energy of bolt 24 in first direction 256 so that bolt spring 252 can return bolt through the loading positions and then advance a projectile 26 to a position where projectile 26 can be fired from bore 16. In embodiments, such kinetic energy could be transferred to end wall 251 directly or by way of intermediate structures including but not limited to forward assist 270.

However, where this is done, bolt 24 returns to loading area 21 in less time than would be required than in the embodiments of FIGS. 15-18 where buffer spring 272 is used to absorb such kinetic energy over time, and to return a portion of the kinetic energy to bolt 24 again over a period of time. The time required for buffer spring 272 to do this adds to the overall time that bolt 24 is positioned outside of loading area 21 thus providing more time for projectile supply system 18 to position a projectile 26 in loading area 21.

After bolt 24 has been redirected to travel in second direction 258 the rate of return of bolt 24 to loading position 21 and bore 16 is largely controlled by the release of first bolt return potential energy BRPE1 against bolt 24 by bolt spring 252. Because bolt spring 252 has a lower spring rate, bolt is urged to move at a rate that is appropriate for passing through loading area 21, engaging projectile 26 and positioning projectile 26 for firing.

The lower spring rate of bolt spring 252, the higher spring rate of buffer spring 272, and the extent to which bolt spring 252 and buffer spring 272 are compressed during movement of bolt 24 in first direction 256 are also selected so that projectile loading system 18 can move a projectile 26 into loading area 21 within the amount of time required for bolt 24 to travel to the return position, for buffer spring 272, and bolt spring 252 to reverse the direction of bolt 24 and for bolt spring 252 and buffer spring 272 to then return bolt tip 240 through loading area to bore 16 and the fired position shown in FIG. 16.

Further, it will be appreciated that because bolt 24 has a mass that is much larger than the mass of projectile 26, bolt 24 will have sufficient kinetic energy to help to ensure the insertion of projectiles 26 into bore 16.

It will be appreciated that in bolt drive system 220, the timing and extent of the displacement of bolt spring 252 is a function of the separation between bolt spring engagement surface 244 and bolt spring positioner 274, similarly the timing of and extent of the displacement of buffer spring 272 is a function of the separation of end wall 251 and buffer spring positioner 276. These variables can be adjusted to adapt to the needs of particular systems and requirements.

In embodiments, airgun 10 may be configured to receive one of a plurality of forward assists 270 each having a bolt spring positioner 274 and a buffer spring positioner 276 adapted to optimize the operation of bolt drive system 220 for semi-automatically loading different types of projectiles 26, projectile storage systems 20, or ranges of pressures of motive flow 55.

In embodiments, bolt spring 252 and buffer spring 272 can be stacked or joined together in other ways.

What is claimed is:

1. An airgun, comprising:

a valve configured to release pressurized gas when the valve is transitioned from a closed position to an open position;

a hammer configured to move from a hammer cocked position to a hammer fire position in which the hammer causes the valve to release the pressurized gas;

a primary sear movable between a primary sear cocked position where the primary sear holds the hammer at the hammer cocked position, and a primary sear fired position where the primary sear permits the hammer to transition to the hammer fire position;

a secondary sear movable between a secondary sear cocked position where the secondary sear holds the primary sear in the primary sear cocked position, and a secondary sear fired position where the secondary sear permits the primary sear to transition to the primary sear fired position;

a trigger movable between a non-firing position and a fired position; and a lift engaged with the trigger and the secondary sear when the trigger is in the non-firing position, and disengaged from the secondary sear when the trigger is in the fired position, wherein:

a trigger spring is positioned to urge movement of the trigger from the fired position to the non-firing position, and movement of the trigger from the fired position to the non-firing position causes movement of the lift, and reengagement between the lift and the secondary sear.

2. The airgun of claim 1, wherein the movement of the trigger to the non-firing position comprises rotation of the trigger about a trigger pivot, and wherein rotation of the trigger causes commensurate rotation of the lift about the trigger pivot.

3. The airgun of claim 1, wherein the secondary sear is biased, by a sear spring, to return from the secondary sear fired position to the secondary sear cocked position.

4. The airgun of claim 1, wherein the primary sear has a primary sear return surface that is positioned to be driven by the hammer when the hammer is traveling to the return position.

5. The airgun of claim 1, wherein movement of the trigger from the non-firing position to the firing position causes the secondary sear to move from the secondary sear cocked position to the secondary sear fired position, thereby permitting movement of the primary sear from the primary sear cocked position to the primary sear fired position.

6. The airgun of claim 5, wherein force applied by a hammer spring, to the hammer, drives the hammer to move laterally along a hammer path in a first direction, and wherein movement of the hammer in the first direction drives rotation of the primary sear.

7. The airgun of claim 6, wherein movement of the hammer in the first direction transitions the valve from the closed position to the open position.

8. The airgun of claim 6, wherein movement of the hammer along the hammer path in a second direction opposite the first direction causes the hammer to strike the primary sear, the primary sear being urged, by the secondary sear, to return to the primary sear cocked position.

9. The airgun of claim 1, wherein as the trigger spring urges movement of the trigger from the firing position to the non-firing position, the lift pivots against a bias force applied by the trigger spring.

10. The airgun of claim 9, wherein the secondary sear includes an engagement surface disposed within a travel path of the lift such that:

the lift contacts the engagement surface as the lift pivots against the bias force, and contact between the engagement surface and the lift causes an end of the lift to follow a diversion path around the engagement surface as the trigger returns to the non-firing position.

11. The airgun of claim 1, further comprising a loading system configured to load a projectile into a loading area of the airgun for ejection from the airgun in response to a flow of the pressurized gas.

12. A method of operating an airgun, comprising:

holding a spring-biased hammer in a hammer cocked position by engaging the hammer with a primary sear;

holding the primary sear in a primary sear cocked position by engaging the primary sear with a secondary sear;

receiving a pull force on a trigger, the pull force causing the trigger to pivot from a non-firing position to a fired position, wherein transitioning the trigger to the fired position:

causes movement of the secondary sear, the movement of the secondary sear enables movement of the primary sear from the primary sear cocked position to a primary sear fired position, the movement of the primary sear to the primary sear fired position permits the hammer to move, under force of a hammer spring, from the hammer cocked position to a hammer fire position, and the movement of the hammer to the hammer fire position causes pressurized gas to be released from a valve; and returning the trigger to the non-firing position under force of a trigger spring, wherein:

a lift is engaged with the secondary sear and the trigger when the trigger is in the non-firing position, and is disengaged from the secondary sear when the trigger is in the fired position, and returning the trigger to the non-firing position causes movement of the lift, and reengagement between the lift and the secondary sear.

13. The method of claim 12, further comprising returning the hammer from the hammer fire position to the hammer cocked position using a portion of the pressurized gas released from the valve and force from a valve spring, wherein the force is applied by the valve spring to a stem impacted by the hammer when the hammer is in the hammer fire position.

14. The method of claim 13, further comprising engaging a primary sear return surface of the primary sear with the hammer as the hammer returns from the hammer fire position to the hammer cocked position, the primary sear being urged, by the secondary sear, to return to the primary sear cocked position as the hammer returns to the hammer cocked position.

15. The method of claim 14, further comprising returning, using force applied by a sear spring to the secondary sear, the secondary sear to a secondary sear cocked position in which the secondary sear holds the primary sear in the primary sear cocked position.

16. The method of claim 12, wherein the secondary sear includes an engagement surface disposed within a travel path of the lift such that:

the lift contacts the engagement surface as the lift reengages the secondary sear, and contact between the engagement surface and the lift causes an end of the lift to follow a diversion path around the engagement surface as the trigger returns to the non-firing position.

17. An airgun, comprising:

a hammer configured to move, under force applied by a hammer spring, from a hammer cocked position to a hammer fire position, the hammer causing pressurized gas to be released when the hammer is in the hammer fire position;

a primary sear moveable relative to the hammer and configured to hold the hammer at the hammer cocked position;

a secondary sear configured to permit movement of the primary sear relative to the hammer;

a trigger configured to move, against force applied by a trigger spring, from a non-firing position to a fired position; and a lift engaged with the trigger and the secondary sear when the trigger is in the non-firing position, and disengaged from the secondary sear when the trigger is in the fired position, wherein:

movement of the trigger from the non-firing position to the fired position causes movement of the primary sear and the secondary sear, and enables the hammer to move from the hammer cocked position to the hammer fire position, and movement of the trigger, under force of the trigger spring, from the fired position to the non-firing position causes movement of the lift, and reengagement between the lift and the secondary sear.

18. The airgun of claim 17, wherein the movement of the trigger from the non-firing position to the fired position comprises rotation of the trigger about a trigger pivot, and wherein rotation of the trigger causes commensurate rotation of the lift about the trigger pivot.

19. The airgun of claim 17, wherein:

the movement of the hammer from the hammer cocked position to the hammer fire position comprises lateral movement of the hammer along a hammer path in a first direction, and movement of the hammer in the first direction drives rotation of the primary sear.

20. The airgun of claim 19, wherein:

the hammer is configured to move, against force applied by the hammer spring, along the hammer path in a second direction opposite the first direction, from the hammer fire position to the hammer cocked position, and movement of the hammer along the hammer path in the second direction causes the hammer to strike the primary sear.

* * * * *